US009988799B1

(12) United States Patent
Yu

(10) Patent No.: US 9,988,799 B1
(45) Date of Patent: Jun. 5, 2018

(54) SINK WITH TRI-MOUNTABLE SINK RIM

(71) Applicant: Shujen Yu, Edgewater, NJ (US)

(72) Inventor: Shujen Yu, Edgewater, NJ (US)

( * ) Notice: Subject to any disclaimer, the term of this patent is extended or adjusted under 35 U.S.C. 154(b) by 604 days.

(21) Appl. No.: 14/289,952

(22) Filed: May 29, 2014

Related U.S. Application Data

(63) Continuation of application No. 11/580,638, filed on Oct. 13, 2006, now abandoned.

(51) Int. Cl.
*E03C 1/33* (2006.01)
*E03C 1/18* (2006.01)

(52) U.S. Cl.
CPC ..... *E03C 1/18* (2013.01)

(58) Field of Classification Search
USPC ..... 4/632, 635, 634, 633, 660; 29/890.14, 29/890.141
See application file for complete search history.

(56) References Cited

U.S. PATENT DOCUMENTS 2,193,018 A 3/1940 Batcheller
2,456,065 A * 12/1948 Just ..... 4/637
2,505,828 A 5/1950 Fox
3,778,884 A 12/1973 Bene
4,150,472 A 4/1979 Derain
4,175,292 A * 11/1979 Morrison ..... 4/660
D317,197 S 5/1991 Gocke et al.
D317,198 S 5/1991 Gocke et al.
D317,357 S 6/1991 Blanc et al.
D317,647 S 6/1991 Jung et al.
D318,104 S 7/1991 Blanc et al.
D318,523 S 7/1991 Blanc et al.
D319,300 S 8/1991 Stairs, Jr.
D319,494 S 8/1991 Stairs, Jr.
D319,688 S 9/1991 Jung et al.
D319,870 S 9/1991 Gocke et al.
D320,067 S 9/1991 Gocke et al.
D322,842 S 12/1991 Jung et al.
(Continued)

OTHER PUBLICATIONS

Serope Kalpakjian, Manufacturing Engineering and Technology—Second Edition, Section 16.2, pp. 456 and 457, 1992, Addison-Wesley Publishing Company, Inc, USA.
(Continued)

*Primary Examiner* — Lauren Crane
(74) *Attorney, Agent, or Firm* — Ryan T. Grace; Advent, LLP

(57) ABSTRACT

A sink assembly includes a basin formed of a metallic material. The basin has a plurality of downwardly depending basin walls. The basin also includes an outwardly extending peripheral mounting flange comprising a flat upper surface and a flat lower surface. The peripheral mounting flange is welded to the basin along the periphery of the plurality of downwardly depending basin walls and extends along a single plane. The peripheral mounting flange is capable of supporting the entire weight of the basin without flexing when the sink is installed in a flush mounted configuration. The sink assembly also includes clips configured to be secured to a countertop, and adjustment screws adjustably coupled with the clips. The adjustment screws are vertically adjustable to support the peripheral mounting flange so that the upper surface of the peripheral mounting flange is flush with the countertop.

20 Claims, 20 Drawing Sheets

(56) References Cited

U.S. PATENT DOCUMENTS

| | | | | |
|---|---|---|---|---|
| D322,845 | S | 12/1991 | Gocke et al. | |
| D322,846 | S | 12/1991 | Gocke et al. | |
| D323,704 | S | 2/1992 | Stairs, Jr. | |
| D323,705 | S | 2/1992 | Stairs, Jr. | |
| D329,279 | S | 9/1992 | Blanc et al. | |
| D344,576 | S | 2/1994 | Stairs, Jr. | |
| D346,014 | S | 4/1994 | Berge et al. | |
| D351,221 | S | 10/1994 | Berge et al. | |
| D355,023 | S | 1/1995 | Kolada | |
| D355,949 | S | 2/1995 | Laughton | |
| D380,529 | S | 7/1997 | Laughton | |
| 5,683,638 | A | 11/1997 | Crigler et al. | |
| D393,057 | S | 3/1998 | Gardner et al. | |
| D398,706 | S | 9/1998 | Gardner et al. | |
| D398,970 | S | 9/1998 | Gardner et al. | |
| 5,870,783 | A * | 2/1999 | Stoll et al. | 4/619 |
| 6,016,578 | A * | 1/2000 | Malouf | 4/619 |
| D422,346 | S | 4/2000 | Svendsen | |
| D423,652 | S | 4/2000 | Kolada | |
| D423,653 | S | 4/2000 | Svendsen | |
| D424,665 | S | 5/2000 | Svendsen | |
| D424,666 | S | 5/2000 | Svendsen | |
| D426,288 | S | 6/2000 | Kolada | |
| D426,623 | S | 6/2000 | Svendsen | |
| D427,670 | S | 7/2000 | Svendsen et al. | |
| D429,319 | S | 8/2000 | Kolada | |
| D430,925 | S | 9/2000 | Svendsen et al. | |
| D439,959 | S | 4/2001 | Jones | |
| D445,883 | S | 7/2001 | Svendsen et al. | |
| 6,267,136 | B1 | 7/2001 | Johnson | |
| D450,374 | S | 11/2001 | Svendsen et al. | |
| D451,585 | S | 12/2001 | Svendsen et al. | |
| D452,300 | S | 12/2001 | Jones | |
| D463,538 | S | 9/2002 | Chipperfield | |
| D475,127 | S | 5/2003 | Svendsen et al. | |
| D475,771 | S | 6/2003 | Svendsen et al. | |
| 6,591,434 | B1 * | 7/2003 | De Cleene et al. | 4/619 |
| D478,970 | S | 8/2003 | Ziemann et al. | |
| D482,106 | S | 11/2003 | Ziemann et al. | |
| D486,566 | S | 2/2004 | Ziemann | |
| D495,037 | S | 8/2004 | Ziemann | |
| D506,245 | S | 6/2005 | Painter | |
| D508,555 | S | 8/2005 | Ziemann | |
| D510,418 | S | 10/2005 | Painter | |
| D518,881 | S | 4/2006 | Ziemann | |
| 2004/0148696 | A1 | 8/2004 | Clarke | |
| 2004/0181870 | A1 | 9/2004 | Bohacik et al. | |

OTHER PUBLICATIONS

Michael Litchfield, Renovation—3rd Edition, p. 320, 2005, ISBN 1-56158-588-2. The Taunton Press, USA.

Istallation Guide: Self-Rimming Stainless Steel Sinks, online product installation manual, Oct. 1, 2006, pp. 1-6, vol. reference No. 101 9942-2-B, Kohler Co., United States.

Installation Instructions, online product installation manual, Oct. 1, 2006, pp. 1-4, vol. reference 790766-100, American Standard, Inc., United States.

Culinare Collection Stainless Steel Kitchen Sinks, online product specification, Oct. 1, 2006, pp. 1-4, vol. reference 790767-100. American Standard, Inc., United States.

Installation Guide Beveled Stainless Steel Sinks, online product installation manual, Oct. 1, 2006, pp. 1-8, vol. reference 1021992-2-A, Kohler Co., United States.

Advertisement of Poggen Pohl, Aug. 1, 2006. 1 page.

Webpage Advertisement for Triple Basin Stainless Steel Sink for kitchensandbath.com, Oct. 1, 2006, 2 pages, United States.

Webpage Advertisement, www.handcraftedmetal.com/stainless-sink-select-aprons.html, Oct. 1, 2006, 3 pages, United States.

Webpage Advertisement, www.rensup.com/glass-sinks/10654.htm, Oct. 1, 2006, 1 page, United States.

Woodweb, Inc., Under-Mounting a Top-Mount Sink webpage Jun. 17, 2005, 2 pages, Woodweb, Inc., Montrose,US http://www.woodweb.com/knowledge_base/UnderMounting_a_TopMount_Sink.html.

www.unitedlabequip.com-Products/sink/Epoxy_resin/drop_in_sinks.htm, 4 pages, United States.

Webpage Advertisement. www.absolutehome.com, Oct. 1, 2006, 4 pages, United States.

Webpage catalog extract, www.homeportfolio.com/catalog, Oct. 1, 2006, 9 pages, United States.

"Everything about the kitchen sink", www.desesne.info/improve-Your-Home/kitchens/kitchen-sinks.htm, Oct. 1, 2006, 3 pages, United States.

Webpage Advertisement, http://shop.blanco.de/html, Oct. 1, 2006, 5 pages, United States.

* cited by examiner

SINK WITH TRI-MOUNTABLE SINK RIM

CROSS-REFERENCE TO RELATED APPLICATIONS

The present application is a continuation under 35 U.S.C. § 120 of U.S. patent application Ser. No. 11/580,638, filed Oct. 13, 2006, and titled "Sink with tri-mountable sink rim," which is herein incorporated by reference in its entirety.

BACKGROUND

Sinks are ubiquitous fixtures in both commercial and residential kitchens and bathrooms. Modern sinks add both functionality and esthetic appeal with designer sinks being manufactured from many materials and in many artistic designs. In the current marketplace, stainless steel sinks are particularly desirable. Most applications utilize fairly standard sized sink fixtures and cabinets to accommodate the limitations of existing spaces and to reduce the cost of pure custom designed furniture and plumbing work.

In recent years, countertops and sinks have developed into an important architectural feature of the kitchen. Materials used for countertops have expanded, as well as the artistic fashion in which sinks and countertops are engaged with one another. The variety and flexibility of component parts is increasingly demanded by designers and users.

Residential kitchen and bathroom sinks are often installed in cabinets. Drop in sinks are self-rimming sink units where the sink is set through a pre-cut hole in the countertop. The flange or lip around the sink provides a substantial portion of the support. Under mount sinks are mounted from beneath the counter with no flange or lip showing. The sink is held in place with adhesive as the primary securing means. The adhesive bonds the top surface of the flange to the bottom surface of the countertop.

SUMMARY

A sink assembly includes a basin formed of a metallic material. The basin has a plurality of downwardly depending basin walls. The basin also includes an outwardly extending peripheral mounting flange comprising a flat upper surface and a flat lower surface. The peripheral mounting flange is welded to the basin along the periphery of the plurality of downwardly depending basin walls and extends along a single plane. The peripheral mounting flange is capable of supporting the entire weight of the basin without flexing when the sink is installed in a flush mounted configuration. The sink assembly also includes clips configured to be secured to a countertop, and adjustment screws adjustably coupled with the clips. The adjustment screws are vertically adjustable to adjust and support the peripheral mounting flange so that the upper surface of the peripheral mounting flange is flush with the countertop.

Thus, having broadly outlined the more important features of the present disclosure in order that the detailed description thereof may be better understood, and that the present contribution to the art may be better appreciated, there are, of course, additional features of the present disclosure that will be described herein and will form a part of the subject matter of the claims appended to this specification.

In this respect, before explaining at least one embodiment of the disclosure in detail, it is to be understood that the disclosure is not limited in its application to the details of construction and the arrangements of the components set forth in the following description or illustrated in the drawings. The present disclosure is capable of other embodiments and of being practiced and carried out in various ways. Also it is to be understood that the phraseology and terminology employed herein are for the purpose of description and should not be regarded as limiting.

BRIEF DESCRIPTION OF THE DRAWINGS

The disclosure will be described by reference to the specification and the drawings, in which like numerals refer to like elements, and wherein.

The drawings are not to scale, in fact, some aspects have been emphasized for a better illustration and understanding of the written description.

DETAILED DESCRIPTION

Figure 1:
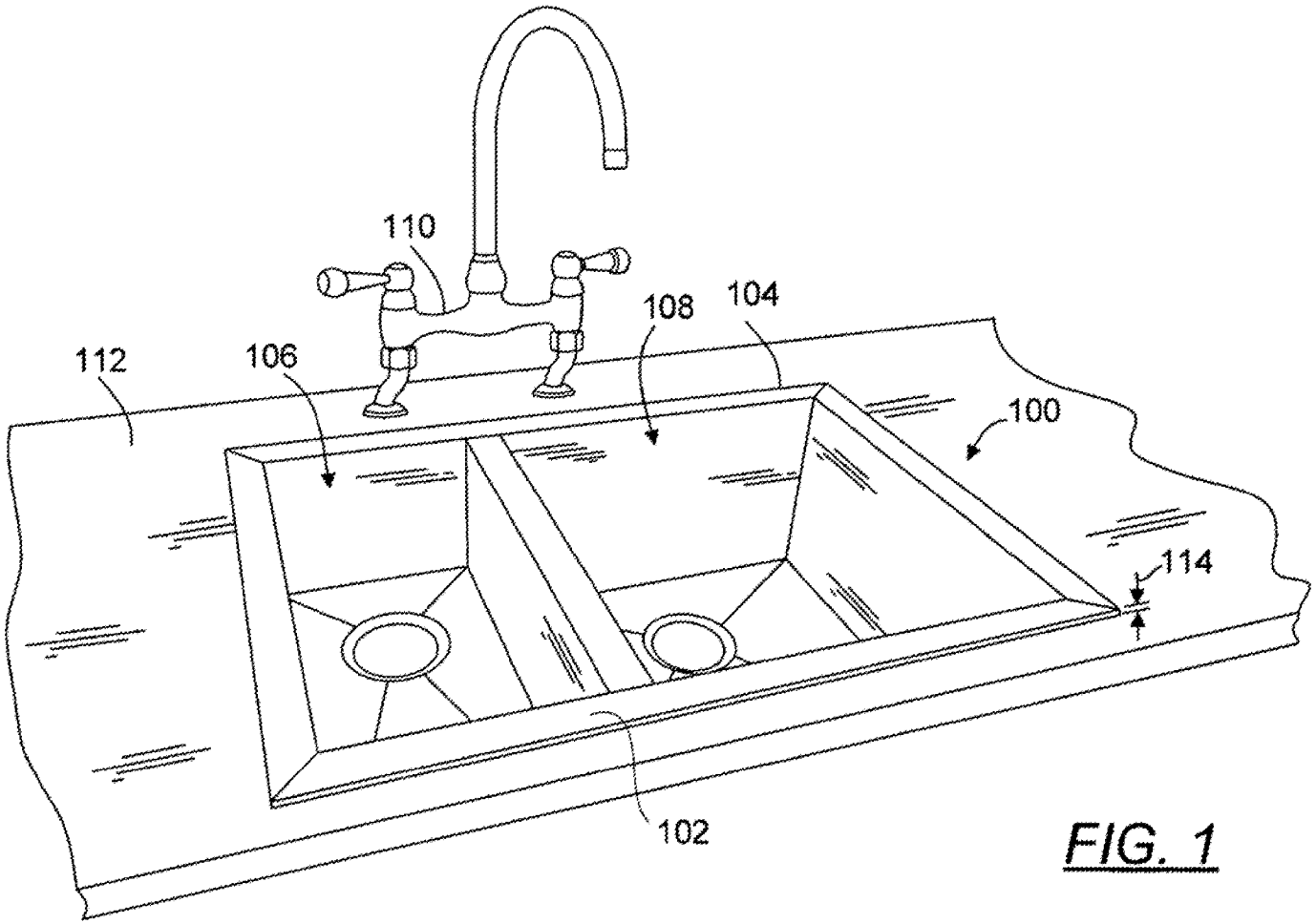
FIG. 1 is a perspective view of one embodiment of a tri-mountable sink assembly mounted by drop in method.
Figure 2:
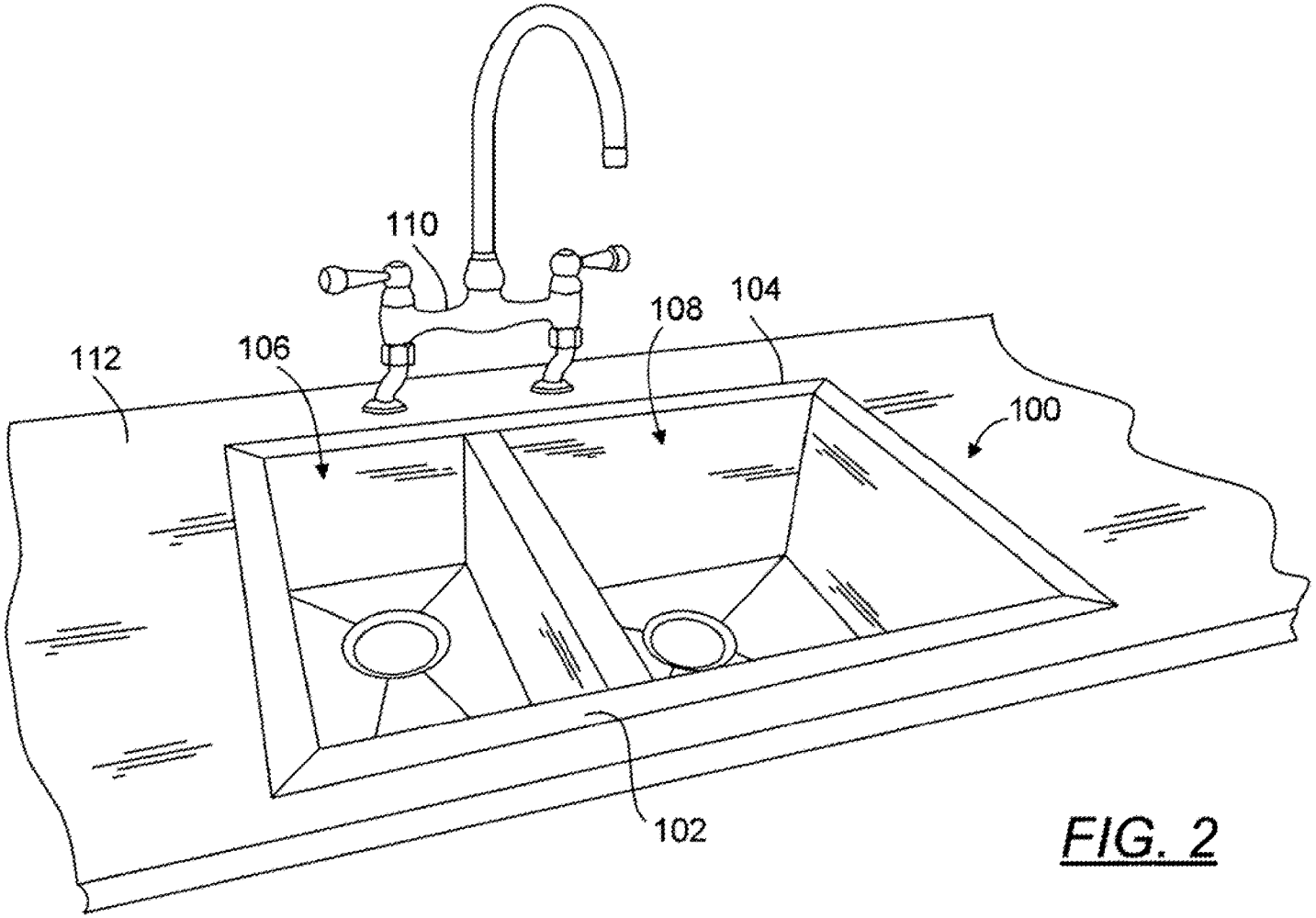
FIG. 2 is a perspective view of one embodiment of a tri-mountable sink assembly mounted by flush mount method.
Figure 3:
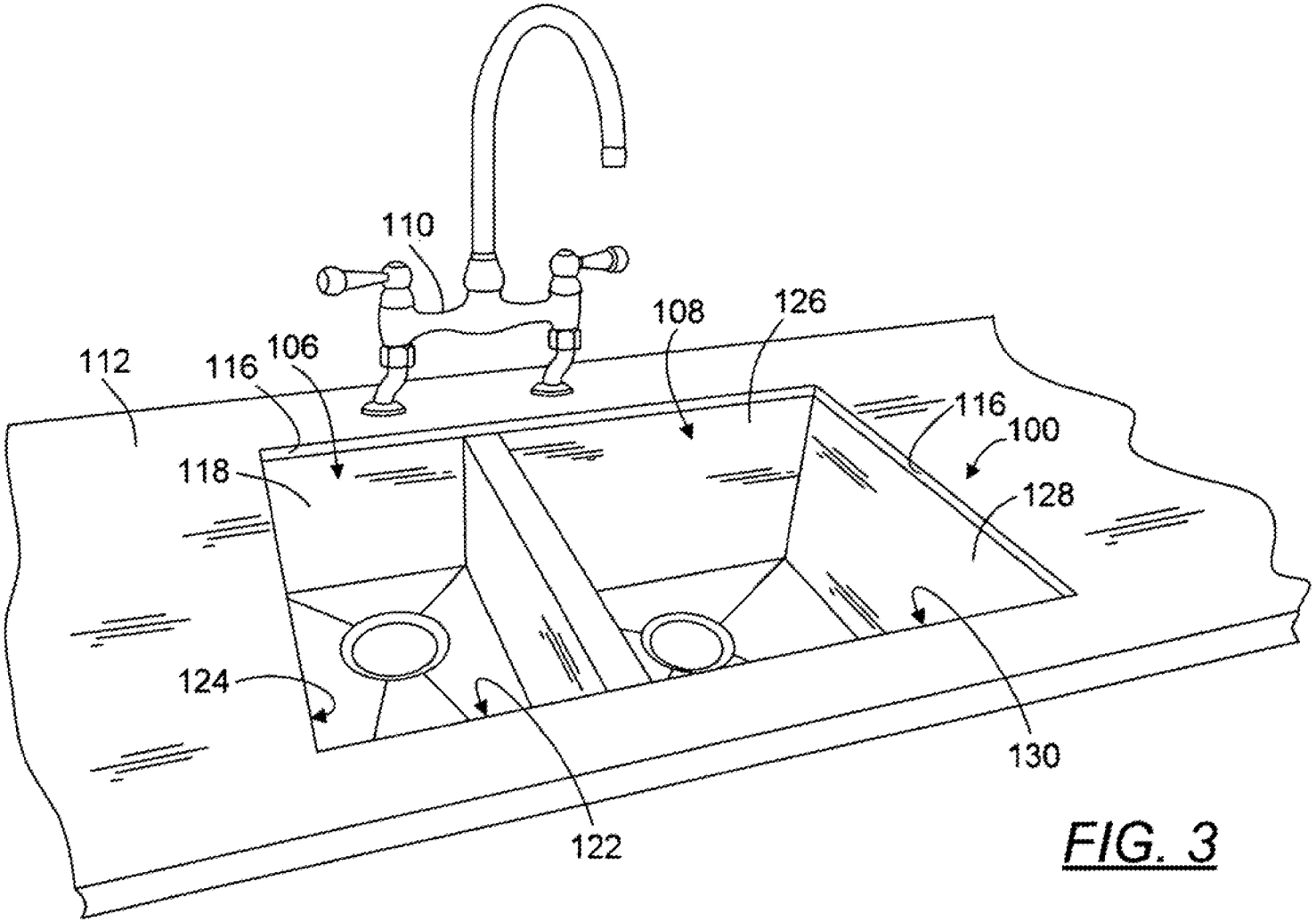
FIG. 3 is a perspective view of one embodiment of a tri-mountable sink assembly mounted by under mount method.

The sink assembly and sink rim of this disclosure are adaptable to be mounted via three conventional mounting methods: drop in, under mount and flush mount. The features of the sink rim and sink assembly described herein render them more versatile than sink assemblies and sink rims of the prior art. FIG. 1 depicts a tri-mountable sink assembly 100 mounted in a countertop 112 via a conventional drop in method. FIG. 2 depicts tri-mountable sink assembly 100 mounted in a countertop 112 via a conventional flush mount method. FIG. 3 depicts tri-mountable sink assembly 100 mounted in a countertop 112 via a conventional under mount method.

Referring to FIG. 1, tri-mountable sink assembly 100 comprises an outwardly extending peripheral mounting flange 102, a first basin 106, and a second basin 108. In the embodiment depicted, faucet controls 110 are disposed in countertop 112 in proximity of rear longitudinal side 104. The full outwardly extending peripheral mounting flange 102 is disposed over the countertop 112 such that the depth 114 of the outwardly extending peripheral mounting flange 102 is visible when mounted for use. In this mounting style, it is the underside (not visible in this view) of the outwardly extending peripheral mounting flange 102 that is in contacting engagement with countertop 112.

As used in this specification, basin shall mean a basin-like, water impervious container that facilitates the collection of liquids, solids, and the like. It is to be understood and within the scope of this disclosure that a basin of this disclosure takes many shapes and sizes in various embodiments. By way of illustration, but not limitation, a basin of this disclosure may be a single basin, a double basin, a triple basin and the like.

Referring to FIG. 2, where tri-mountable sink assembly 100 is installed via a flush mount method, the depth 114 visible in FIG. 1 (the vertical exterior edge) is disposed in the countertop 112 and is not visible when mounted for use. The exposed surface of the outwardly extending peripheral mounting flange 102 and the countertop are in the same plane, thus creating the "flush" horizontal transition between the two and a visually harmonious transition. In this mounting style, it is both the underside (not visible in this view) and the vertical exterior edge of the outwardly extending peripheral mounting flange 102 that are in contacting engagement with countertop 112. In one embodiment, the countertop 112 is prepared for sink mounting with a surface cut-out and a sunken mounting ledge that is adapted to receive the outwardly extending peripheral mounting flange. In this embodiment, the underside of the outwardly extending peripheral mounting flange is in contacting engagement with the upper surface of the mounting ledge.

Referring to FIG. 3, where tri-mountable sink assembly 100 is installed via an under mount method, the outwardly extending peripheral mounting flange 102 (not visible in this view) is disposed below the countertop 112 and is not visible when mounted for use. The exposed vertical surface of the countertop cutout 116 and the basin walls 118, 122, 124, 126, 128, 130 are in the same plane, thus creating a "flush" downward and visually harmonious transition between the two.

Figure 4:
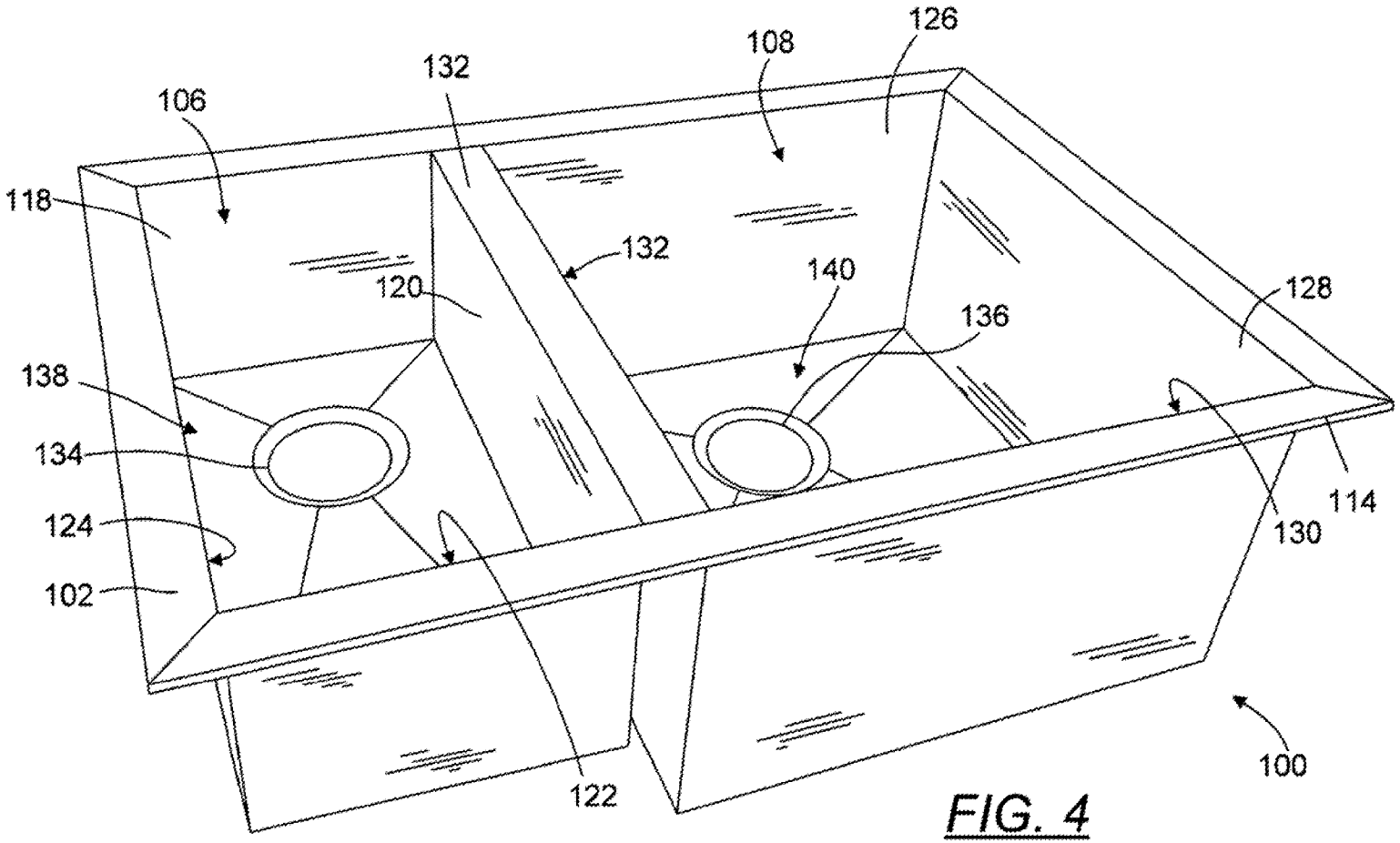
FIG. 4 is a perspective view of one embodiment of an unmounted tri-mountable sink assembly.

FIG. 4 depicts tri-mountable sink assembly 100 in an uninstalled state. In the aspect of the embodiment depicted, tri-mountable sink assembly 100 comprises an outwardly extending peripheral mounting flange 102, a first basin 106, and a second basin 108. First basin 106 and second basin 108 are divided transversely by dividing wall 132. In a preferred embodiment, said first basin 106, second basin 108, and dividing wall 132 are integrally formed as a single component. In some embodiments, each of said first basin 106, second basin 108, and dividing wall 132 are individual components permanently and fixedly assembled into a unitary structure with said outwardly extending peripheral mounting flange 102. Outwardly extending peripheral mounting flange 102 is integrally bound to first basin 106 and second basin 108 in a unitary sink unit.

In one embodiment, outwardly extending peripheral mounting flange 102 and basins 106, 108 are metallurgically integral at their contiguous points of contact, thereby creating said unitary sink unit. In one aspect of this embodiment, welding is used to fixedly engage said contiguous points of contact.

Referring again to FIG. 4, first basin 106 comprises four downwardly depending basin walls 118, 120, 122, 124 and first base member 138. First drainage aperture 134 is disposed in first base member 138. First base member 140 is integrally bound to the downwardly depending basin walls 118, 120, 122, 124.

Referring again to FIG. 4, second basin 108 comprises four downwardly depending basin walls 126, 128, 130, 132 and second base member 140. Second drainage aperture 136 is disposed in second base member 140. Second base member 140 is integrally bound to the downwardly depending basin walls 126, 128, 130, 132.

Figure 11:
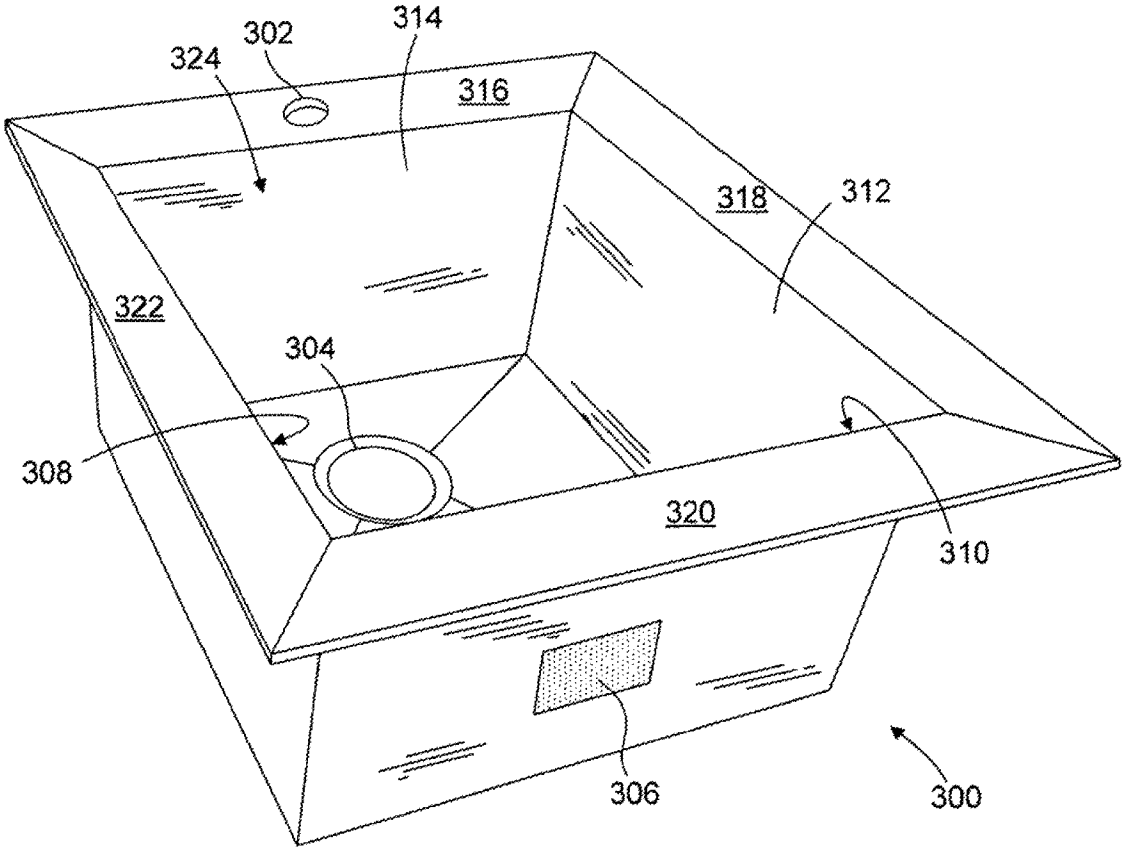
FIG. 11 is a perspective view of one embodiment of a single basin tri-mountable sink assembly.

The embodiment depicted in FIG. 4 is for illustrative purposes only. It is to be understood that first basin 106 and second basin 108 may manufactured in many sizes. For example, in one embodiment, first basin 106 and second basin 108 are the same size. In one embodiment, first basin 106 is larger than second basin 108, and in another embodiment, first basin 106 is smaller than second basin 108. As depicted in FIG. 11, a single basin sink is incorporated rather than a dual basin sink as depicted in FIG. 4.

In one aspect of the embodiment depicted in FIG. 4, said downwardly depending basin walls 118, 120, 122, 124, 126, 128, 130, 132 and base members 138, 140 comprise a metallic material conventionally used in the manufacture of sinks. By way of example, but not limitation, said downwardly depending basin walls comprise copper, bronze, brass or stainless steel.

In a preferred embodiment, said downwardly depending basin walls 118, 120, 122, 124, 126, 128, 130, 132 and base members 138, 140 comprise type 304 stainless steel having a thickness of from about 12 to about 20 gauge (from about 0.0375 to about 0.1094 inches) as measured on the United States standard scale for plate (iron and steel). In one aspect of such embodiment, said downwardly depending basin walls 120, 122, 124, 126, 128, 130, 132 comprise type 304 stainless steel having a thickness of from about 16 to about 18 gauge (from about 0.05 to about 0.0625 inches) as measured on the United States standard scale for plate (iron and steel).

In one aspect of the embodiment depicted in FIG. 4, said outwardly extending peripheral mounting flange 102 comprises a metallic material conventionally used in the manufacture of sinks. By way of example, but not limitation, said downwardly depending basin walls comprise copper, bronze, brass or stainless steel.

In a preferred embodiment, said outwardly extending peripheral mounting flange 102 comprises type 304 stainless steel having a thickness of from about 6 to about 6/0 gauge (from about 0.2031 to about 0.4687 inches) as measured on the United States standard scale for plate (iron and steel). In one aspect of such embodiment, said outwardly extending peripheral mounting flange 102 comprises type 304 stainless steel having a thickness of from about 0.23 inches to about 0.26 inches (substantially about 3 gauge) as measured on the United States standard scale for plate (iron and steel). In one aspect, said outwardly extending peripheral mounting flange 102 comprises type 304 stainless steel having a thickness of from about 0.23 inches to about 0.6 inches. In one preferred embodiment, said outwardly extending peripheral mounting flange 102 comprises type 304 stainless steel having a thickness of about one-half inches.

Applicant believes that this thickness of the outwardly extending peripheral mounting flange provides several functional advantages. The thickness permits the sink rim to be flush mounted. Prior art stainless steel sinks with thinner and narrower outwardly extending peripheral mounting flanges cannot adequately support the weight of the sink basin in a flush mounted configuration. The thicker outwardly extending peripheral mounting flange overcomes this limitation of the prior art.

Additionally, whereas most stainless steel sinks are punched during the manufacturing process to form the basin and flange, the entire sink assembly comprises a single steel type and thickness. Additionally, the exterior edges have a beveled, rolled or rounded configuration. In contrast, Applicant's sink assembly comprises of steel welded together to form a basin and the outwardly extending peripheral mounting flange. By incorporating a thicker and wider outwardly extending peripheral mounting flange, a tri-mountable sink rim is created. Having a flat surface on both the upper and lower surfaces of the outwardly extending peripheral mounting flange, the sink rim and/or sink assembly may be mounted as a drop in or an under mount sink assembly.

Additionally, Applicant's sink rim may be flush mounted. By welding the separate pieces to form the sink assembly, square exterior edges (of from about 85 to about 95 degrees, preferably from about 89 to about 91 degrees) are formed. These square exterior edges, as opposed to rolled or beveled edges, create a truly flush mountable sink rim, overcoming the limitations of prior art sinks. The additional thickness and width of the outwardly extending peripheral mounting flange provide adequate support for the sink assembly when mounted. The square exterior edges of the tri-mountable sink rim eliminate the gaps created by the beveled/rolled edges of the prior art sink rims.

The unique structural design of Applicant's sink rim incorporates three flat surfaces and a square exterior edge of the outwardly extending peripheral mounting flange. The flat upper surface of the outwardly extending peripheral mounting flange facilitates under mounting and/or flush mounting. The flat lower surface, in combination with the width of the outwardly extending peripheral mounting flange, facilitate drop in mounting. The remaining flat vertical surface, in combination with the square exterior edge, thickness, and width of the outwardly extending peripheral mounting flange, facilitate flush mounting.

In one preferred embodiment, said tri-mountable sink assembly 100 comprises a chromium-nickel stainless steel selected from the AISI/SAE 300 series of stainless steels. In another embodiment, said tri-mountable sink assembly 100 comprises a chromium-nickel-manganese alloy stainless steel selected from the AISI/SAE 200 series of stainless steels. Other standardized steels that are used in the manufacture of tri-mountable sink assembly 100 include, but are not limited to, ASTM/AISI steel types 304L, 304LN, 304, 304H and the like. Other standardized steels that are used in the manufacture of tri-mountable sink assembly 100 include, but are not limited to, EN-standard steel types 1.4307, 1.4306, 1.4311, 1.4301, 1.4948, and the like.

In one embodiment, said tri-mountable sink assembly 100 comprises an alloy containing from about 11 to about 30 weight percent of iron and from about 10.5 to about 30 weight percent of chromium.

In one embodiment, said tri-mountable sink assembly 100 comprises an alloy containing from about 11 to about 30 weight percent of iron; from about 10.5 to about 30 weight percent of chromium; and other alloying elements selected from the group consisting of nickel, molybdenum, copper, titanium, aluminum, silicon, nobium, nitrogen, sulphur, selenium and combinations thereof.

In one embodiment, said tri-mountable sink assembly 100 comprises an austenitic stainless steel alloy containing from about 11 to about 30 weight percent of iron, from about 16 to about 26 weight percent of chromium, and from about 8 to about 22 weight percent of nickel. In a preferred embodiment, said tri-mountable sink assembly 100 comprises an austenitic stainless steel alloy containing from about 11 to about 30 weight percent of iron, about 18 weight percent of chromium, and about 10 weight percent of nickel.

In one preferred embodiment of tri-mountable sink assembly 100, component parts of the sink assembly (e.g. basin walls 118, 120, 122, 124, 126, 128, 130, 132; base members 138, 140; and outwardly extending peripheral mounting flange 102) are assembled by a welding process. By way of illustration, but not limitation, suitable welding methods known in the art include shield metal arc welding, gas tungsten arc welding and gas metal arc welding. Filler metal alloys used in the welding process may include, but are not limited to, conventional filler metal alloys Cr—Ni-Austenitic (AISI No. 309, 310, 316, 317, 347) and the like. FIGS. 8A and 8B depict two configurations for assembling and welding some of the component parts of the sink, e.g. basin walls 118, 120, 122, 124, 126, 128, 130, 132 and outwardly extending peripheral mounting flange 102.

Figure 5:
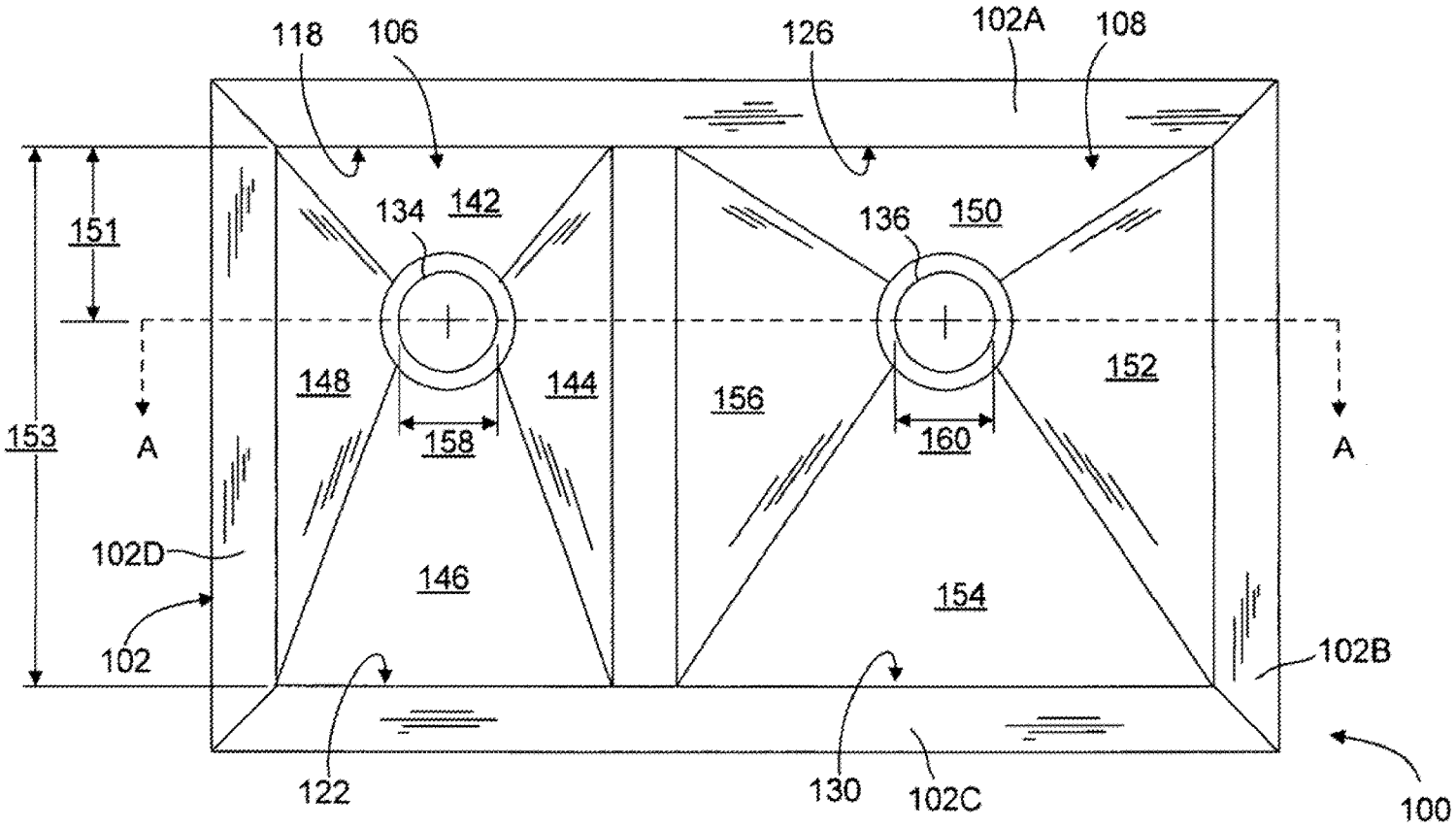
FIG. 5 is a plan view of one embodiment of a tri-mountable sink assembly.

FIG. 5 depicts a plan (top) view of one embodiment of the tri-mountable sink assembly 100. In this view, the features of base members 138, 140 (see FIG. 4) are more clearly depicted. As visible in FIG. 5, first base member 140 (of FIG. 4) comprises anterior base portion 154, posterior base portion 150, first axial base portion 156, second axial base portion 152 and first drainage aperture 136. As visible in FIG. 5, second base member 138 (of FIG. 4) comprises proximal base portion 146, distal base portion 142, third axial base portion 144, fourth axial base portion 148 and second drainage aperture 134.

Referring to FIG. 5, first drainage aperture 136 and second drainage aperture 134 have a diameter 160, 158 of from about three inches to about four inches, preferably about three and five-eighths inches. Preferably, a conventional drain assembly, garbage disposal or the like is mounted in drainage apertures 134, 136 when in use.

Referring to FIG. 5, anterior base portion 154, posterior base portion 150, first axial base portion 156, second axial base portion 152, proximal base portion 146, distal base portion 142, third axial base portion 144, and fourth axial base portion 148 are gently pitched downwardly from the basin walls toward their respective drainage apertures 134, 136 to facilitate the drainage (exiting) of water from the basins 106, 108 via the drainage apertures 134, 136. In a preferred embodiment, the drainage apertures 134, 136 are disposed at the lowest point of their respective base members 138, 140. In one aspect of this embodiment, the downward pitch is from about one to about thirty degrees.

Referring to FIG. 5, outwardly extending peripheral mounting flange 102 comprises four members 102A, 102B, 102C, and 102D. In the embodiment depicted, outwardly extending peripheral mounting flange extends from one-half to six inches, preferably from about one-half to about three inches, outwardly from the basin walls 118, 120, 122, 124, 126, 128, 130, 132 uniformly around the entire periphery in a symmetrical fashion. Thus, a rectangular shaped frame is formed around the basin with an opening with a distance 153 between the interior edges of sections 102C and 102A of outwardly extending peripheral mounting flange 102.

Referring to FIG. 5, in one preferred embodiment, drainage apertures 134, 136 are disposed about base members 138, 140 such that the midpoint of the drainage aperture 134, 136 is disposed at a distance 151 of from about one inch to about six inches from the basin walls 118, 126.

Figure 6:
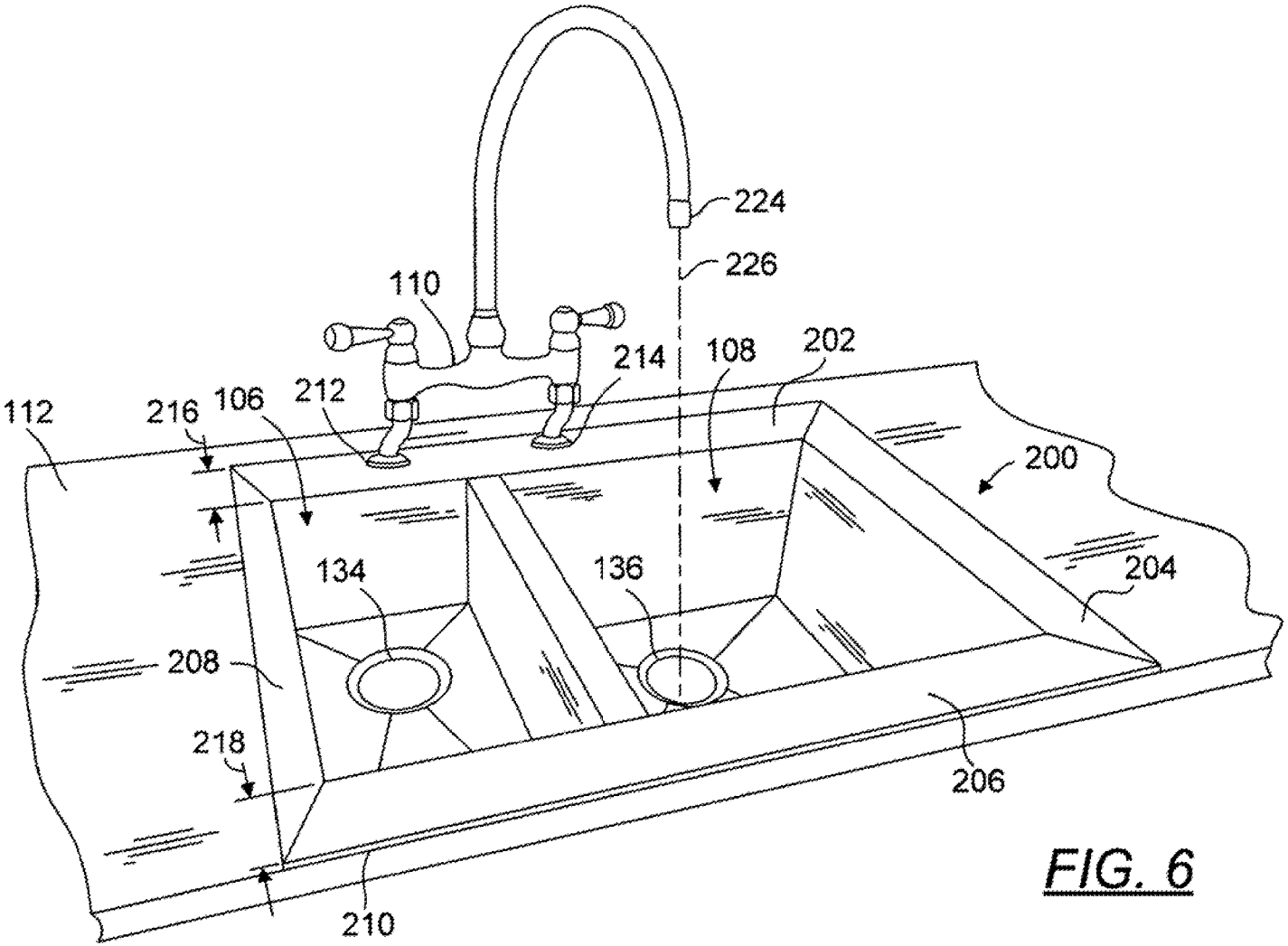
FIG. 6 is a perspective view of one embodiment of a tri-mountable sink assembly mounted by flush mount method.

FIG. 6 depicts a perspective view of one embodiment of tri-mountable sink assembly 200. In this view, tri-mountable sink assembly 200 is top-mounted in countertop 112. The features of tri-mountable sink assembly 200 are substantially the same as depicted and described herein with reference to embodiment 100 with the exception that the outwardly extending peripheral mounting flange is not uniform. In the embodiment 200 depicted, outwardly extending peripheral mounting flange comprises proximal flange portion 206, distal flange portion 202, first transverse flange portion 204 and second transverse flange portion 208.

In one aspect of the embodiment depicted in FIG. 6, proximal flange portion 206 has a width 216 of from about one-half to about six inches, preferably from about one-half to about three inches. In the aspect of this embodiment depicted, proximal flange portion 206 extends from the basin walls to the front edge 210 of countertop 112.

In one aspect of the embodiment depicted in FIG. 6, distal flange portion 202 has a width 218 of from about one-half to about six inches, preferably from about one-half to about three inches. In the aspect of this embodiment depicted, distal flange portion 202 further comprises a plurality of apertures 212, 214 to receive faucet controls 110. It is to be appreciated that only a single such aperture, three apertures or some other combination may be used as required for the desired faucet control, sprayer, or the like. Apertures 212, 214 are preferably disposed along distal flange 202 such that faucet 224 is in proper alignment 226 with the sink basins 106, 108 and/or drainage apertures 134, 136. In a preferred aspect of this embodiment, faucet 224 is in direct alignment with drainage apertures 134, 136 to minimize the noise created by flowing water contacting the base members 138, 140.

Figure 7:
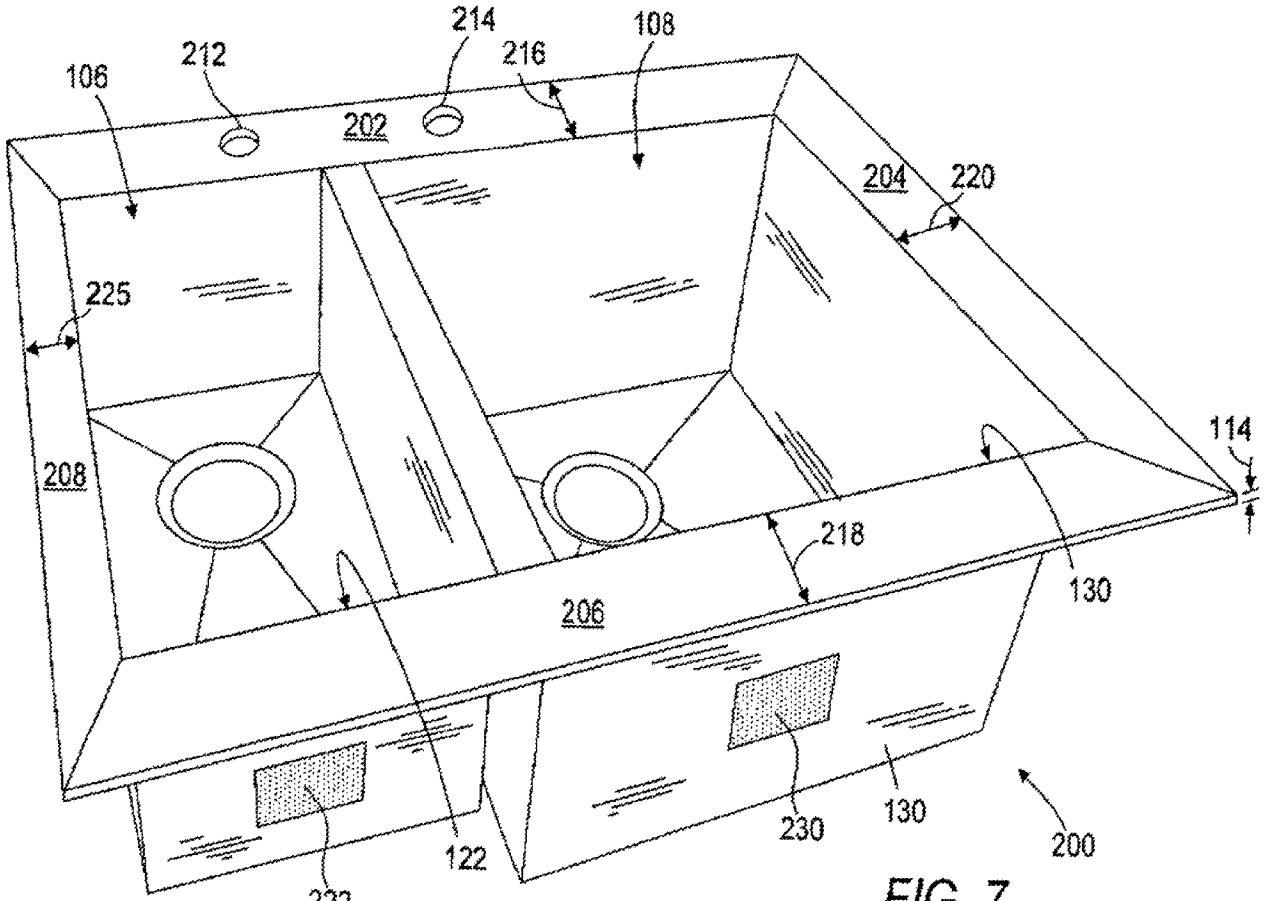
FIG. 7 is a perspective view of the embodiment depicted in FIG. 6 prior to mounting.

FIG. 7 depicts one embodiment of tri-mountable sink assembly 200 prior to mounting. Apertures 212, 214 may be more clearly observed in this view. Optionally and additionally, a plurality of noise reducing devices 222, 230 are affixed along the exterior surfaces of basin walls 122, 130 to soften the noise created when water, dishes and the like come into contact with the basin walls and/or base members. By way of illustration, but not limitation, noise reducing devices comprise rubber. By way of further illustration, a spray-on coating on the entire underside of the sink basin may be used to reduce such noise.

In one aspect of the embodiment depicted in FIG. 7, first transverse flange portion 204 and second transverse flange portion 208 have a width 220, 224 of from about one-half to about three inches. In the aspect of this embodiment depicted, first transverse flange portion 204 and second transverse flange portion 208 have the same width 220, 224. In the aspect of this embodiment depicted, first transverse flange portion 204 and second transverse flange portion 208 have a width 220, 224 that is less than the width 216 of proximal flange portion 206 and/or the width 218 of distal flange portion 202. In the aspect of this embodiment depicted, proximal flange portion 206 and distal flange portion 202 have the same width 216, 218. By way of illustration, but not limitation, first transverse flange portion 204 and second transverse flange portion 208 have a width 220, 224 of about one and one-half inches, distal flange portion 202 has a width 218 of about three inches, and proximal flange portion 206 has a width 216 of about three inches. By way of further illustration, but not limitation, first transverse flange portion 204 and second transverse flange portion 208 have a width 220, 224 of from about one-half to about six inches, distal flange portion 202 has a width 218 of from about one half to about six inches, and proximal flange portion 206 has a width 216 of from about one-half to about six inches.

Figure 8:
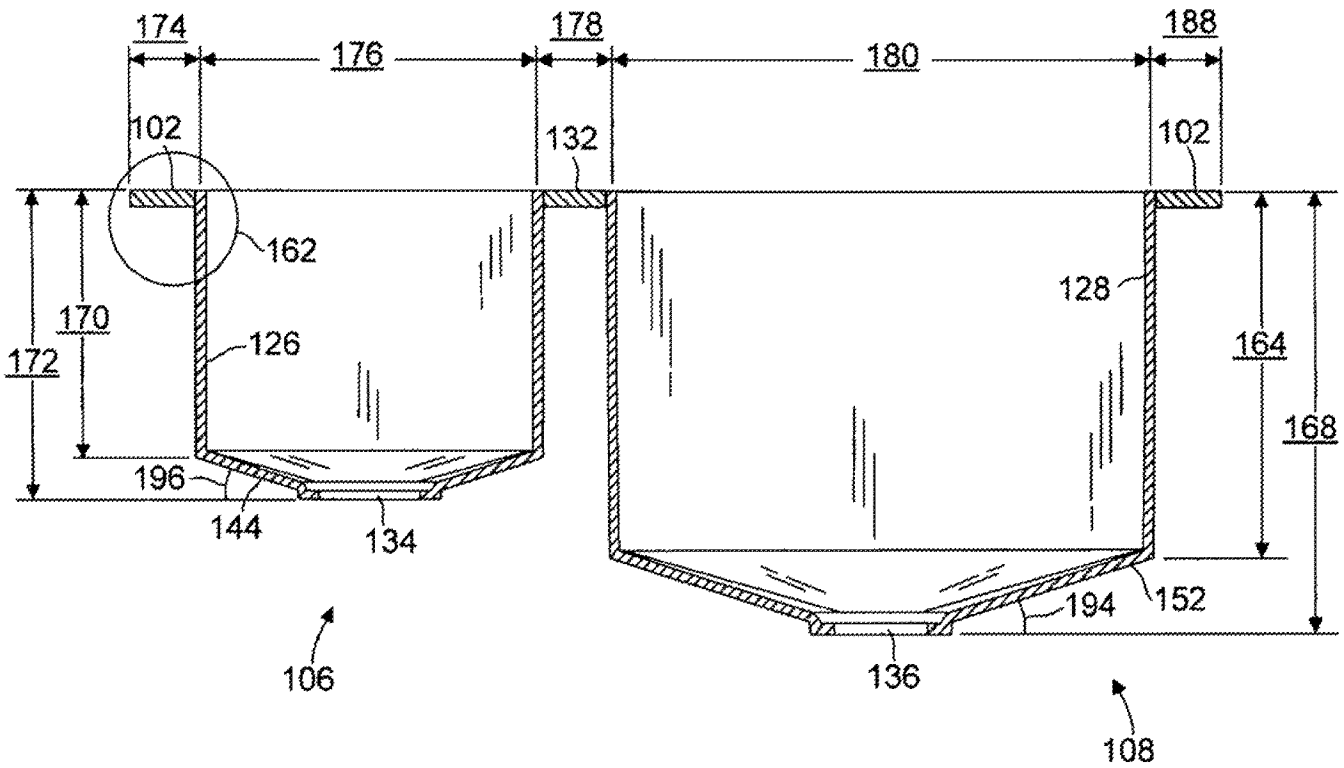
FIG. 8 is a sectional view taken along A-A of FIG. 5.
Figure 8B:
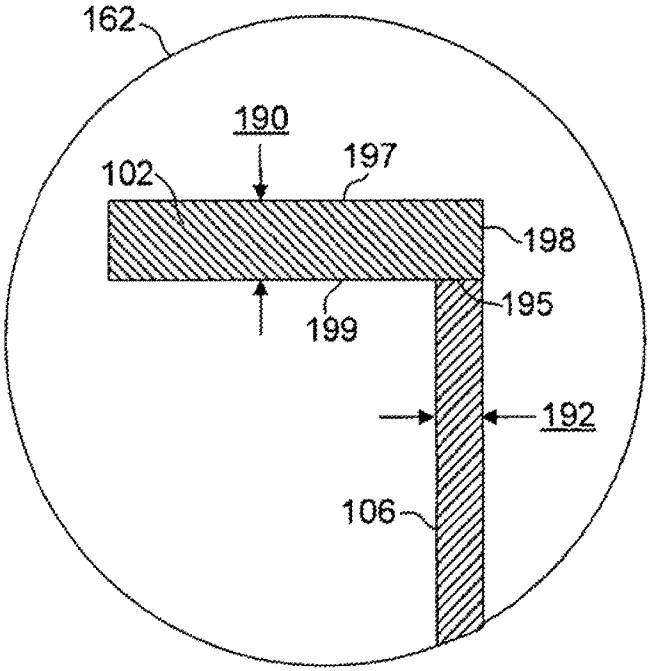
FIGS. 8A, 8B and 8C are detailed views of 162 of FIG. 8 depicting three embodiments of the peripherally extending flange.
Figure 8A:
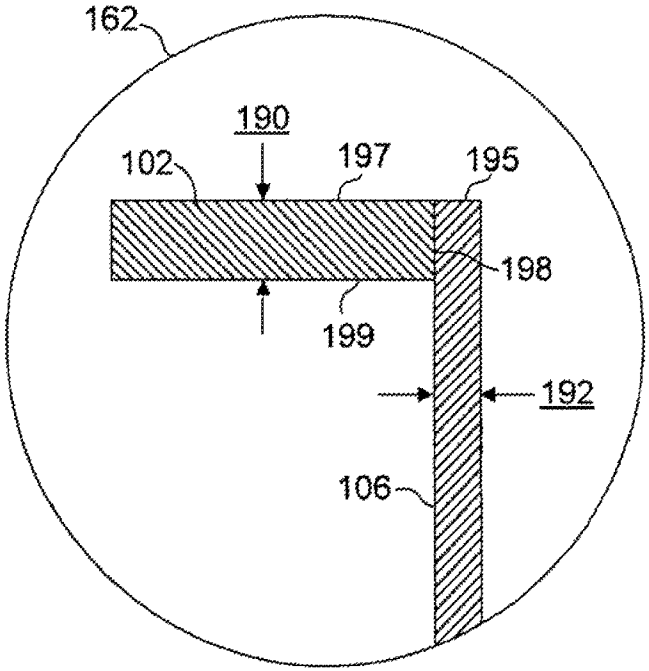

FIG. 8 is a sectional view taken along A-A of FIG. 5 and more clearly depicts the dimensions of basins 106 and 108. Basin 106 has an opening with a distance 176 of from about four to about forty-eight inches. In one embodiment, basin 106 has an opening with a distance 176 of about thirteen inches. Outwardly protruding peripheral mounting flange 102 protrudes a distance 174, 188 of from about one-half inch to about six inches, preferably from about one-half to about three inches. Divider 132 extends a distance 178 of from about one-half to about three inches, preferably from about one to about one and one-half inches. Basin 108 has an opening with a distance 180 of from about four to about forty-eight inches. In one embodiment, basin 108 has an opening with a distance 176 of about nineteen inches. The depth 168 of basin 108 is from about one inch to about nineteen inches. Downwardly depending basin wall 128 extends a distance 164 of from about one inch to about eighteen inches before it junctures with second axial base portion 152. Second axial base portion 152 extends downwardly toward drain aperture 136 at a slope of from about one to about thirty degrees. In one embodiment, angle 194 is from about one degree to about thirty degrees.

Similarly, the depth 172 of basin 106 is from about one inch to about eighteen inches. Downwardly depending basin wall 126 extends a distance 170 of from about one inch to about eighteen inches before it junctures with fourth axial base portion 148. Fourth axial base portion 148 extends downwardly toward drain aperture 134 at a slope of from about one to about thirty degrees. In one embodiment, angle 196 is from about one degree to about thirty degrees.

FIGS. 8A and 8B depict close up sectional views of 162 of FIG. 8. FIG. 8A depicts outwardly extending peripheral mounting flange 102 assembled together with basin 106 such that the top 195 of the basin wall is permanently affixed to the side 198 of and flush with the top 197 of outwardly extending peripheral mounting flange 102. In the embodiment depicted in FIG. 8A, a portion of the basin wall forms part of the outwardly extending peripheral mounting flange 102.

FIG. 8B depicts outwardly extending peripheral mounting flange 102 assembled together with basin 106 such that the top 195 of the basin wall is permanently affixed to the bottom 199 of and flush with the side 198 of outwardly extending peripheral mounting flange 102. In the embodiment depicted in FIG. 8B, the basin wall does not form part of the outwardly extending peripheral mounting flange 102.

Referring to FIGS. 8A and 8B, the thickness 190 of the outwardly extending peripheral mounting flange 102 is greater than the thickness 192 of the basin walls. In one embodiment, the quotient of a thickness 192 of said downwardly depending basin walls divided by a thickness 190 of said outwardly extending peripheral mounting flange is from about 0.08 to about 0.54. In a preferred embodiment, the quotient of a thickness 192 of said downwardly depending basin walls divided by a thickness 190 of said outwardly extending peripheral mounting flange is from about 0.2 to about 0.25.

Figure 8C:
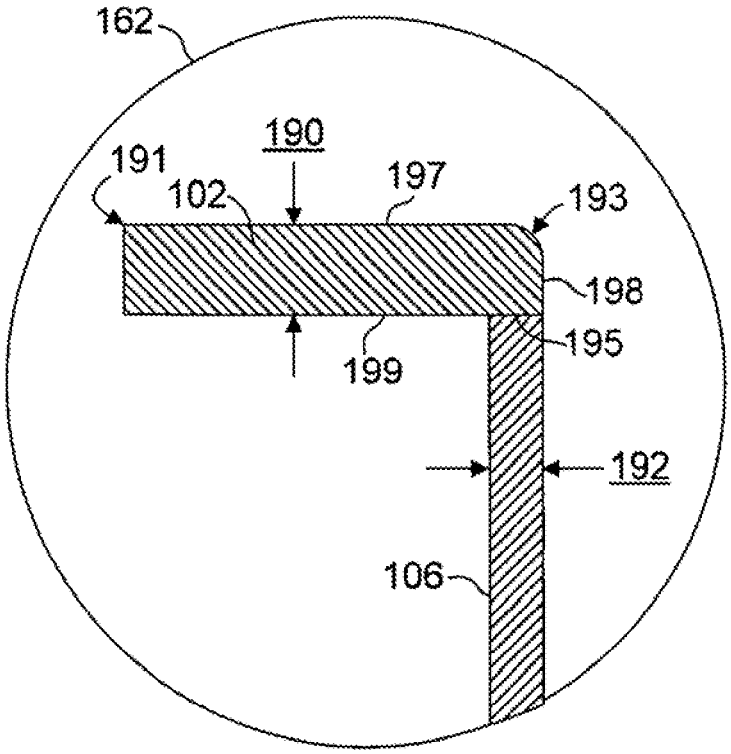

FIG. 8C depicts an alternate embodiment of the outwardly extending peripheral mounting flange 102 shown is FIGS. 8A and 8B. It is substantially the same with the exception that interior edge 193 comprises a slightly rounded edge at the juncture between the outwardly extending peripheral mounting flange 102 and the downwardly depending basin walls 106. In one aspect of this embodiment, the interior edge 193 radius is from about 1/32 inch to about ½ inch. This interior edge 193 differs from the exterior edge 191. The exterior edge 191 of the outwardly extending peripheral mounting flange 102 comprises a substantially square edge of from about 85 to about 95 degrees, thus resulting in an asymmetrical edge along the longitudinal sides of the flange portions. This rounded interior edge 193 prevents sharp edges upon which a user may be lacerated while the substantially square edge 191 facilitates the tri-mountable feature of this sink rim.

Figure 9:
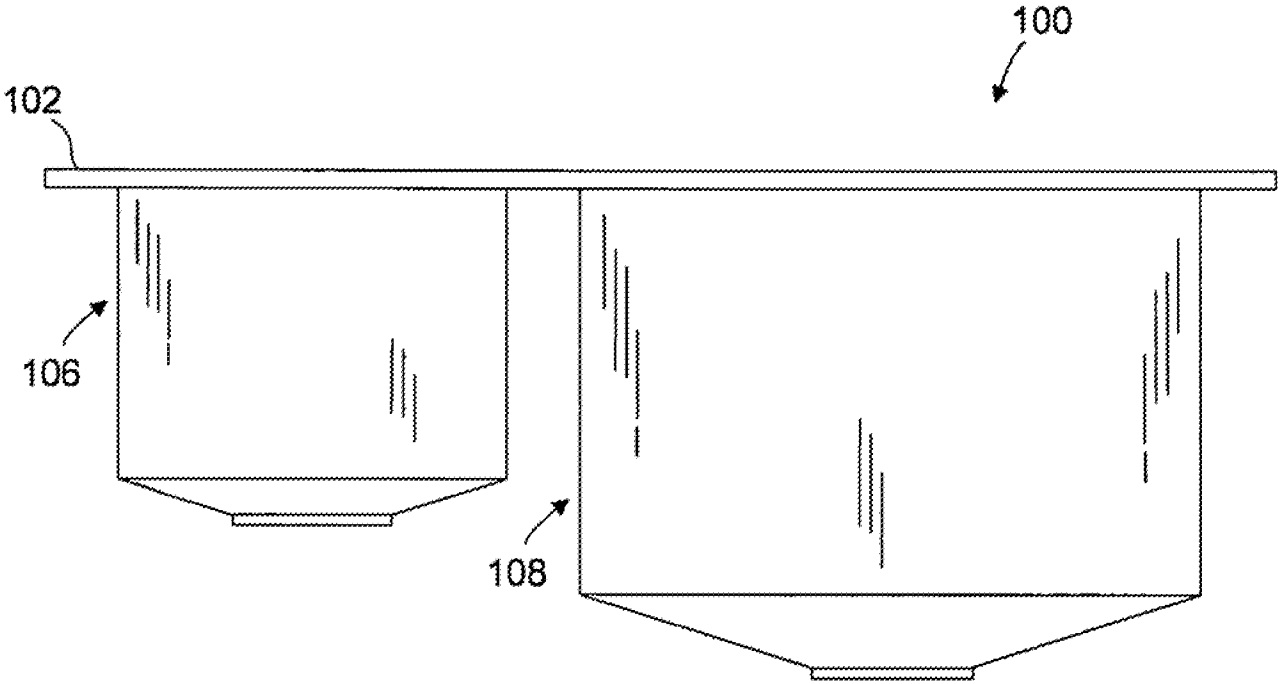
FIG. 9 is an orthogonal front view of an unmounted tri-mountable sink assembly.
Figure 10:
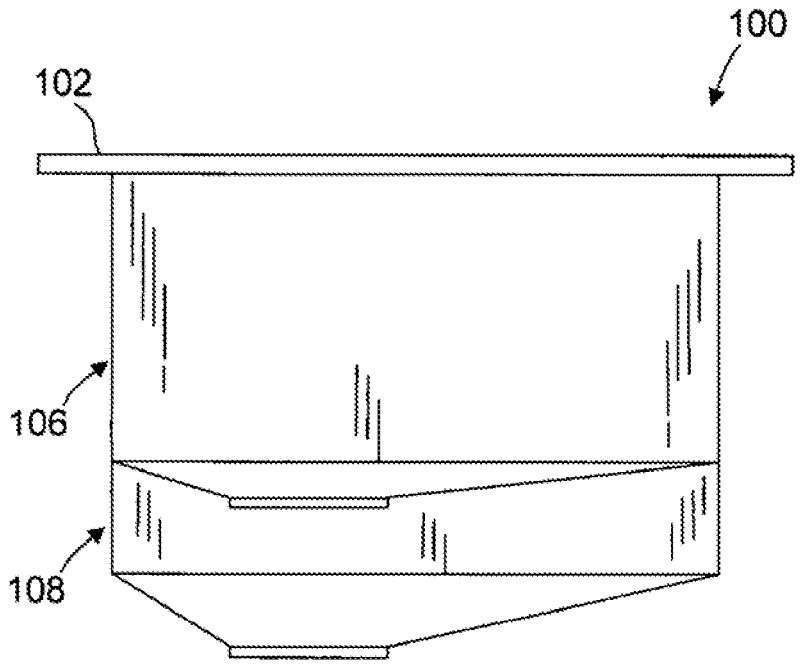
FIG. 10 is an orthogonal side view of an unmounted tri-mountable sink assembly.

FIG. 9 is a front view of tri-mountable sink assembly 100 and FIG. 10 is a side view of tri-mountable sink assembly 100. They depict additional views for further clarification and reference.

FIG. 11 depicts one embodiment of tri-mountable sink assembly 300 which is substantially the same as depicted and described with respect to embodiment 200 with the exception that it comprises a single basin 324. Noise reducing device 306 is affixed along the exterior surface of basin wall 310 and is substantially the same as that described with reference to noise reducing devices 222, 230 of FIG. 7. Optionally and additionally, a plurality of noise reducing devices 306 may be affixed along the exterior surfaces of basin walls 308, 312 and 314. Aperture 203 is adapted to receive faucet controls (not depicted in this view). In the embodiment depicted, aperture 302 is disposed along distal flange portion 316 about its midpoint.

Figure 12:
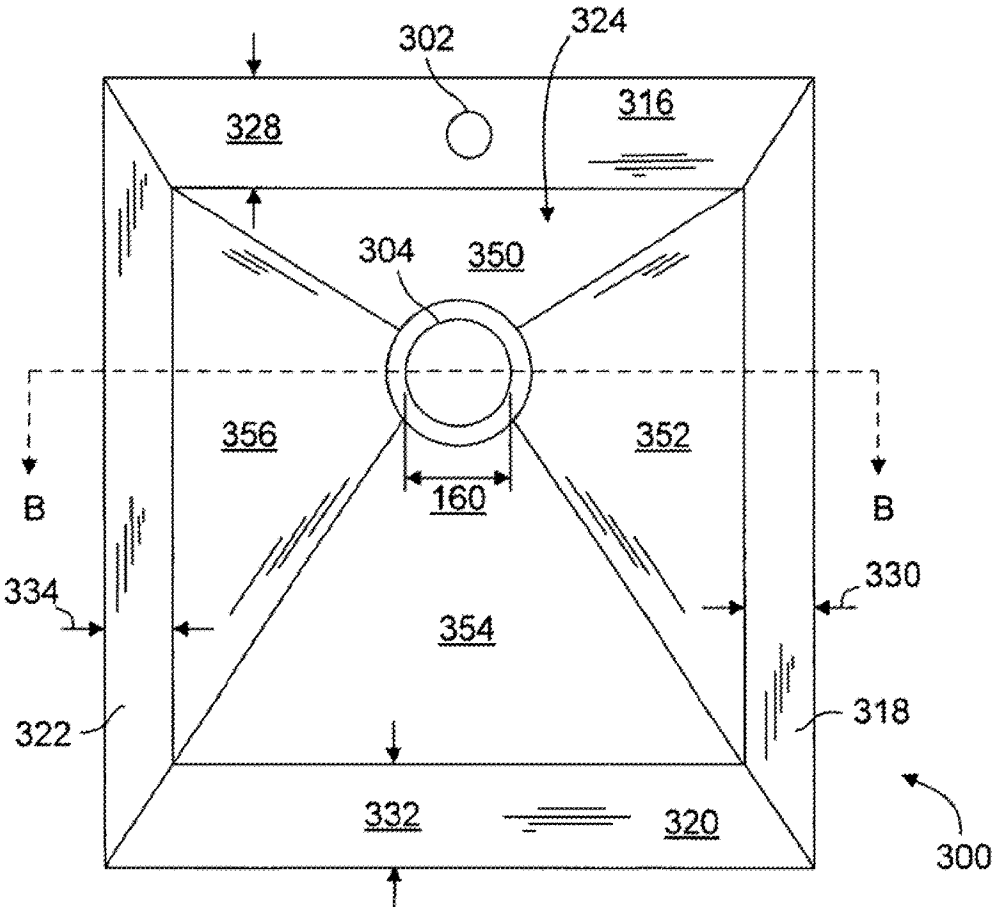
FIG. 12 is a plan view of the embodiment of a tri-mountable sink assembly depicted in FIG. 11.

FIG. 12 is a plan view of embodiment 300. In one aspect of the embodiment depicted in FIGS. 11 and 12, first transverse flange portion 322, second transverse flange portion 318, distal flange portion 316, and proximal flange portion 320 have a width 334, 330, 328, 332 of from about one-half to about six inches, preferably from about one-half to about three inches. In the aspect of this embodiment depicted, first transverse flange portion 322 and second transverse flange portion 318 have the same width 334, 330. In the aspect of this embodiment depicted, first transverse flange portion 322 and second transverse flange portion 318 have a width 334, 330 that is less than or equal to the width 332 of proximal flange portion 320 and/or the width 328 of distal flange portion 316. In the aspect of this embodiment depicted, proximal flange portion 320 and distal flange portion 316 have the same width 332, 328. By way of illustration, but not limitation, first transverse flange portion 322 and second transverse flange portion 318 have the a width 334, 330 of about one and one-half inches, distal flange portion 316 has a width 328 of about one and one-half inches, and proximal flange portion 320 has a width 332 of about one and one-half inches.

Referring again to FIG. 12, anterior base portion 354 is substantially the same as described and depicted with reference to anterior base portion 154 of FIG. 5. Posterior base portion 350 is substantially the same as described and depicted with reference to posterior base portion 150 of FIG. 5; first axial base portion 356 is substantially the same as described and depicted with reference to first axial base portion 156 of FIG. 5; second axial base portion 352 is substantially the same as described and depicted with reference to second axial base portion 152 of FIG. 5. Drainage aperture 304 is substantially the same as described and depicted with reference to first drainage aperture 136 of FIG. 5, having a diameter 160 of from about three inches to about four inches, preferably about three and five-eighths inches. Preferably, a conventional drain assembly, garbage disposal or the like is mounted in drainage aperture 304 when in use.

Figure 13:
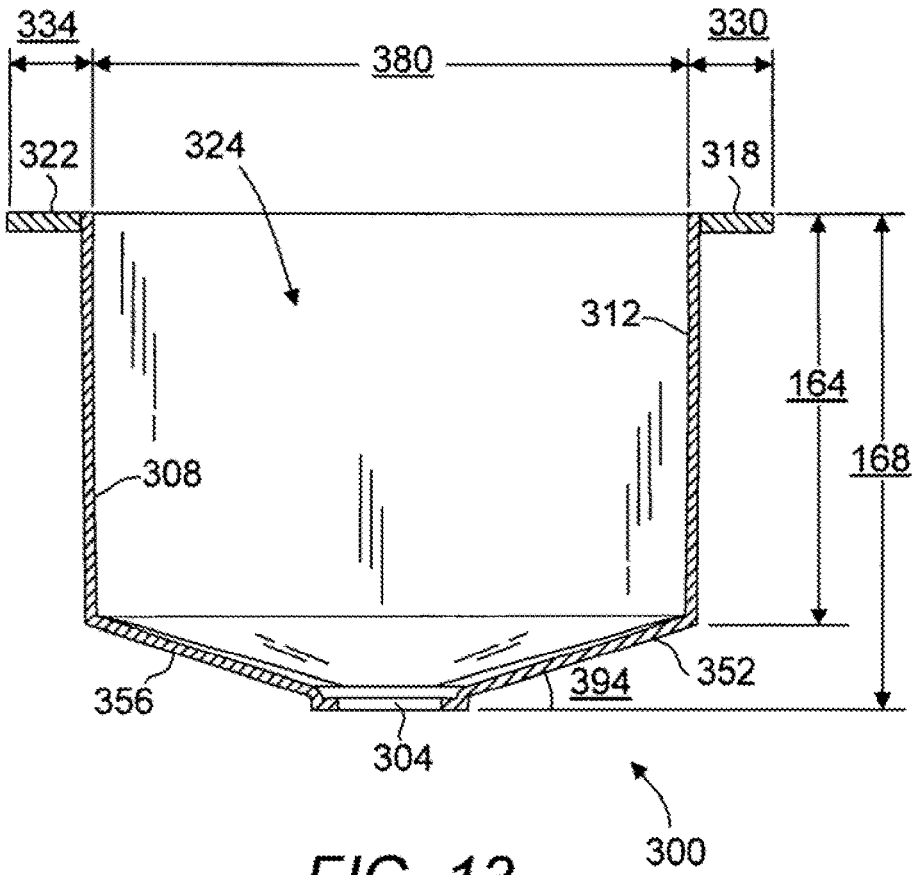
FIG. 13 is a sectional view taken along B-B of FIG. 12.

FIG. 13 is a sectional view of embodiment 300 taken along B-B of FIG. 12. In the embodiment depicted, first transverse flange portion 322 and second transverse flange portion 318 have a width 334, 330 of about one and one-half inches. Basin 324 has an opening that extends a distance 380 between basin walls 308 and 312 of from about four inches to about forty-eight inches. The basin walls 308, 312 depend downwardly from the first transverse flange portion 322 and second transverse flange portion 318 extending a distance 164 of from about one inch to about eighteen inches. The depth 168 of basin 324 at its lowest point at drainage aperture 304 is of from about one inch to about twenty-two inches. Second axial base portion 352 extends downwardly toward drain aperture 304 at a slope of from about one to about thirty degrees. In one embodiment, angle 394 is from about one degree to about thirty degrees.

Figure 15:
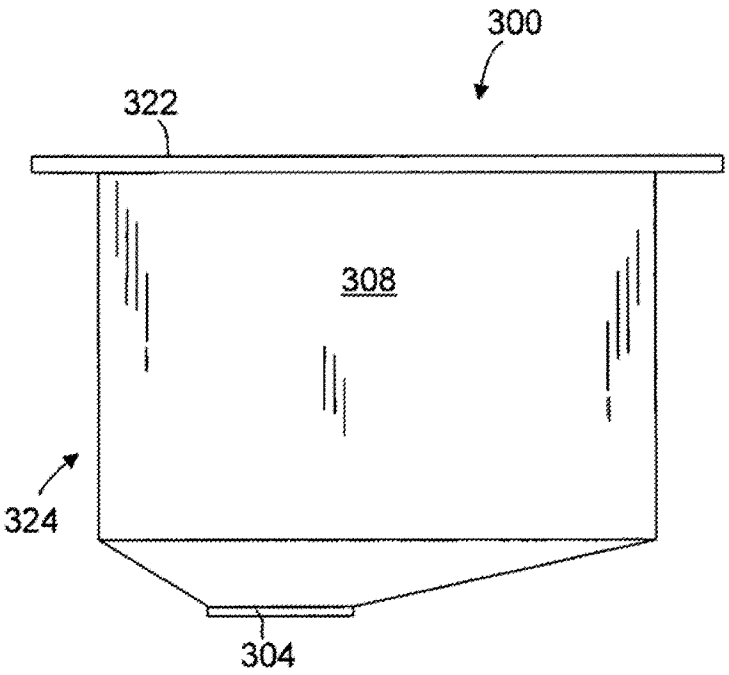
FIG. 15 is an orthogonal side view of the embodiment of a tri-mountable sink assembly depicted in FIG. 11.
Figure 14:
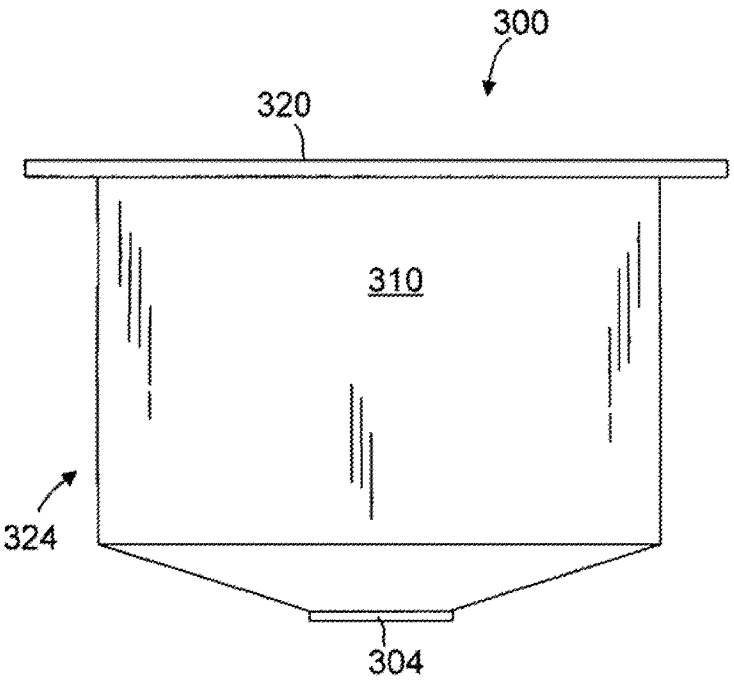
FIG. 14 is an orthogonal front view of the embodiment of a tri-mountable sink assembly depicted in FIG. 11.

FIGS. 14 and 15 are additional views of embodiment 300 to show additional aspects not visible in the other views. FIG. 14 is front view and FIG. 15 is a left side view.

Figure 16:
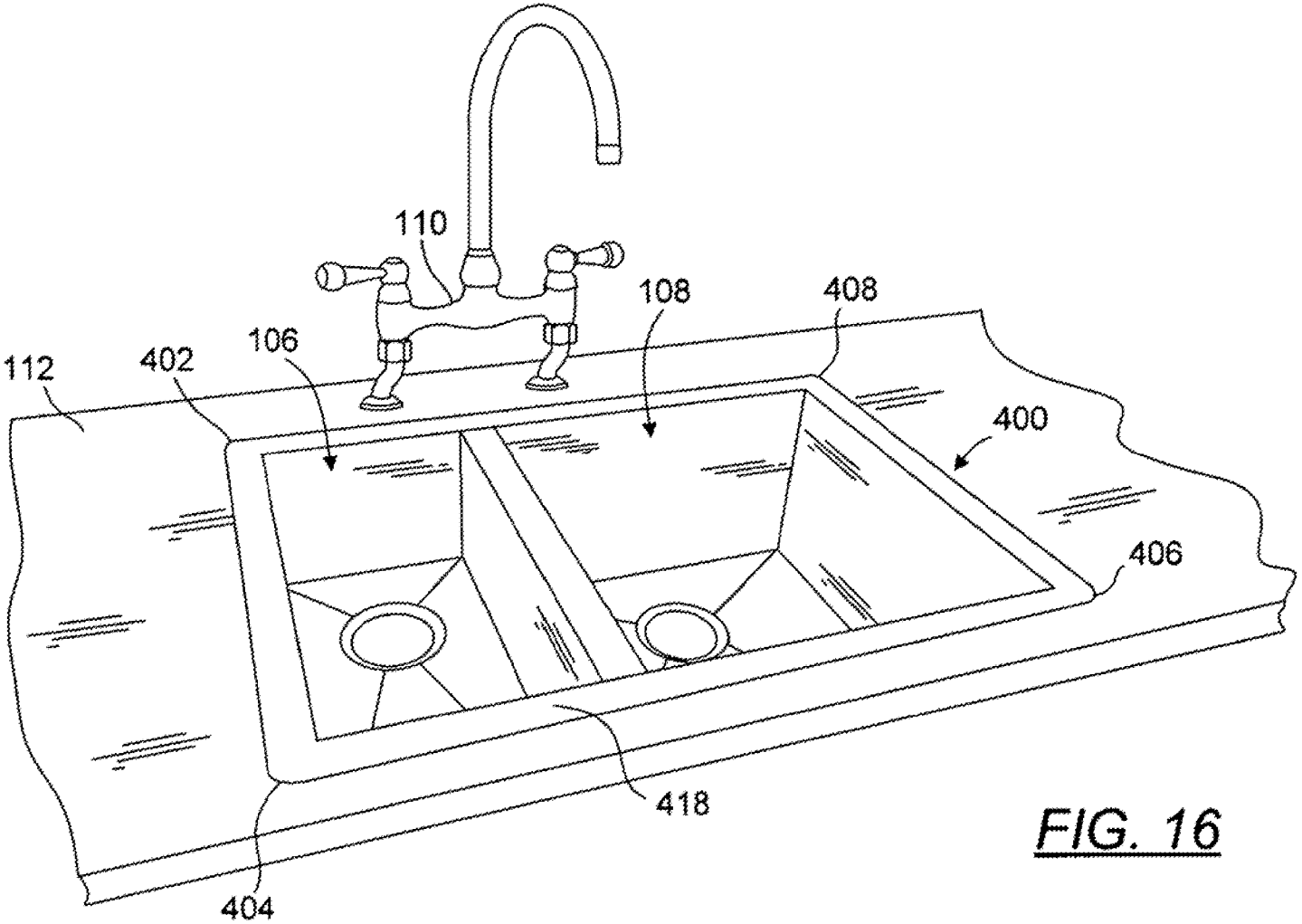
FIG. 16 is a perspective view of one embodiment of a tri-mountable sink assembly mounted by flush mount method.

FIG. 16 depicts one embodiment of tri-mountable sink assembly 400 as flush mounted in countertop 112. The embodiment depicted is substantially the same as depicted and described with respect to embodiments 100, 200 and 300 with the exception that it comprises arcuate corners 402, 404, 406, 408 along the outwardly extending peripheral mounting flange 418. As depicted, this aspect of the embodiment is particularly suited to flush mounting in countertops 112 comprised of CORIAN®, granite, simulated marble, cement, wood, slate, stone, and the like. In the aspect of embodiment 400 depicted in FIG. 16, the faucet controls 110 are disposed in countertop 112.

Figure 17:
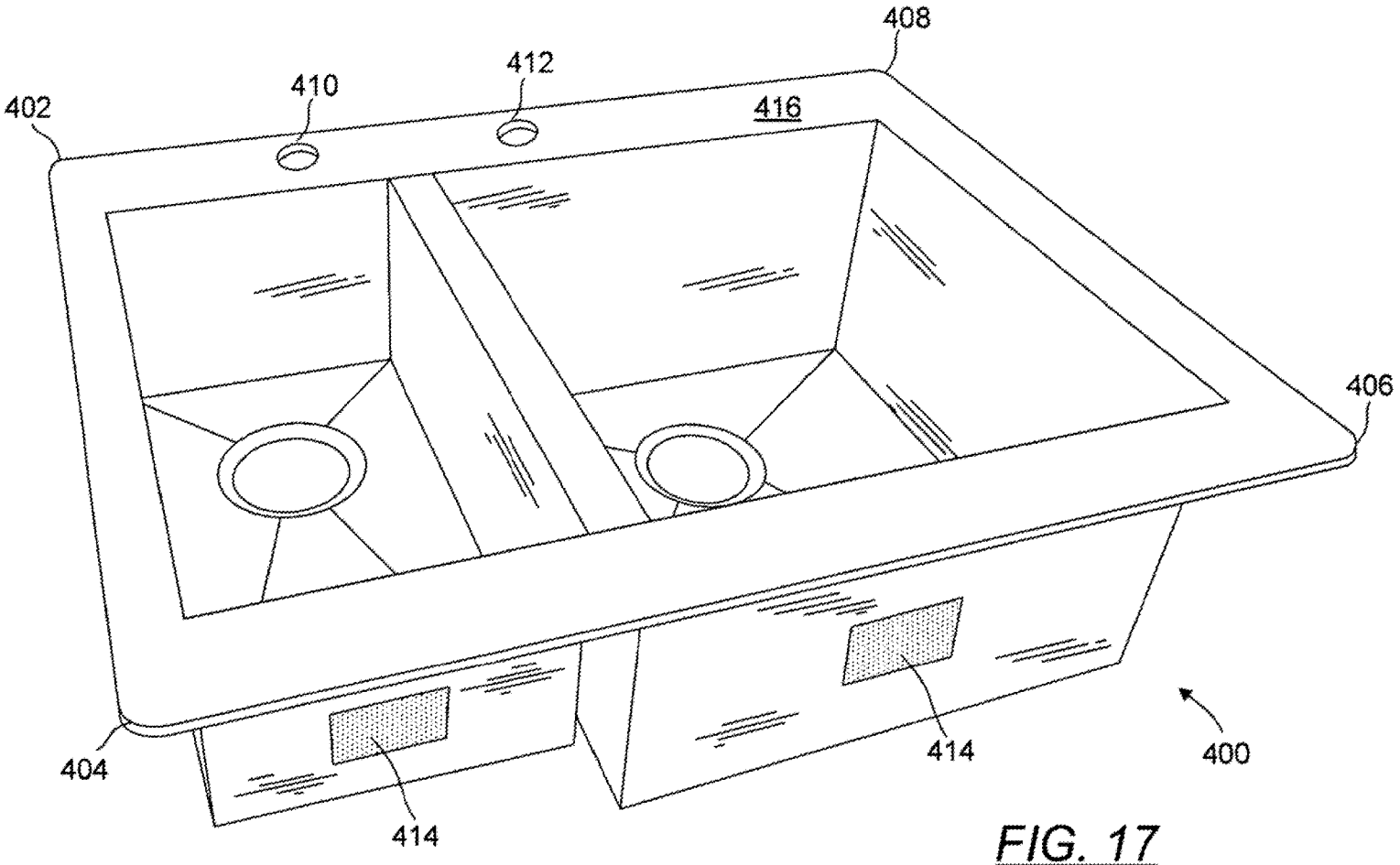
FIG. 17 is a perspective front view of the embodiment of a tri-mountable sink assembly depicted in FIG. 16.

FIG. 17 depicts tri-mountable sink assembly 400 in its unmounted state. In this view, optional noise reducing devices 414 are visibly affixed along a plurality of the basin walls. Said noise reducing devices 414 are substantially the same as that described with reference to noise reducing devices 228, 230 of FIG. 7. Additionally, in the aspect of embodiment 400 depicted in FIG. 17, apertures 410 and 412 are adapted to receive faucet controls (not depicted in this view but see 110 of FIG. 16). In the embodiment depicted, apertures 410, 412 are disposed along distal flange portion 416 in a manner described with reference to FIGS. 5 and/or 6.

Figure 18:
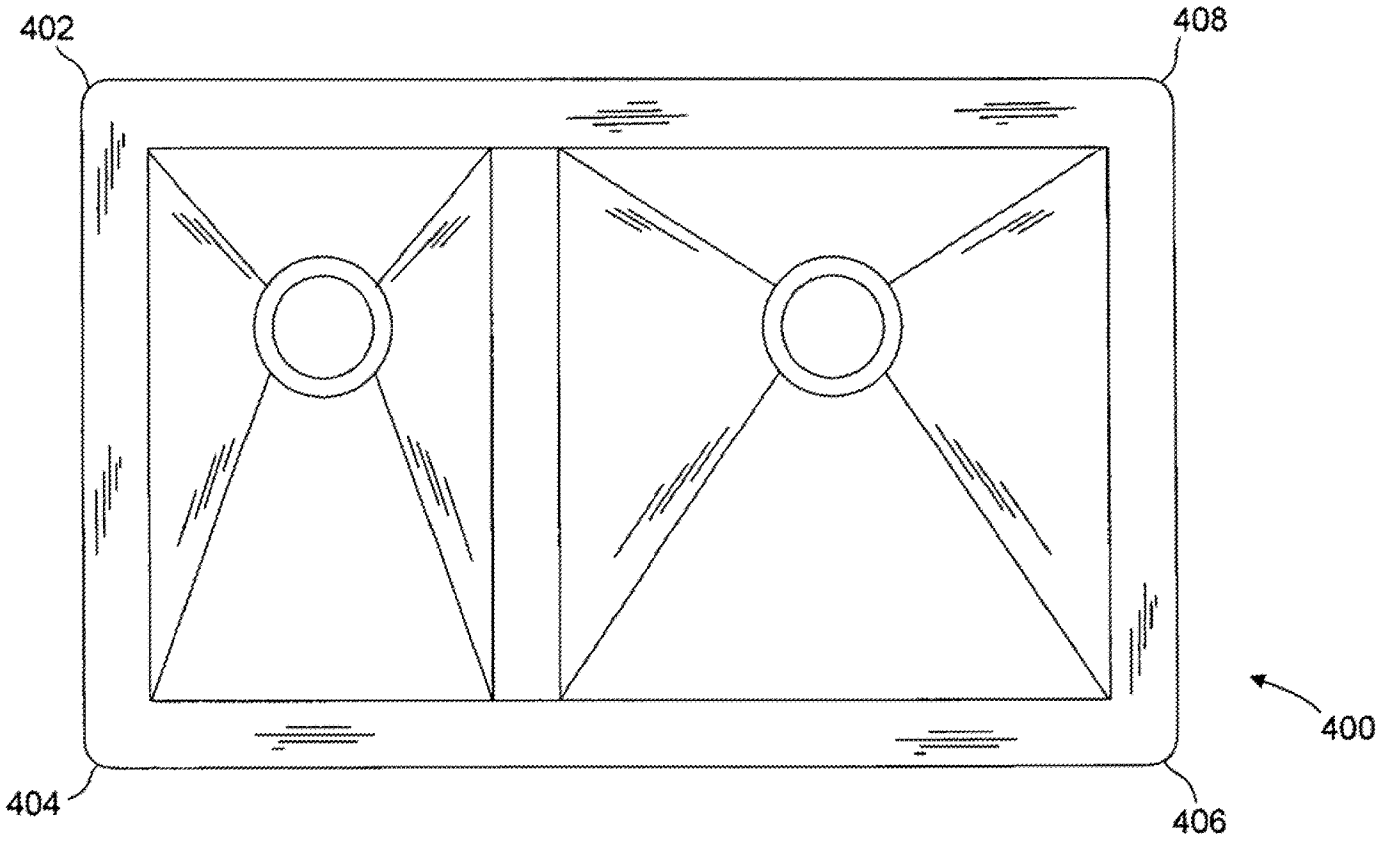
FIG. 18 is a plan view of the embodiment of a tri-mountable sink assembly depicted in FIG. 16.

FIG. 18 is a plan view of embodiment 400. Corners 402, 404, 406 and 408 comprise a radius of from about one-eighth to about one-half inch, preferably about one-quarter inch.

Figure 19:
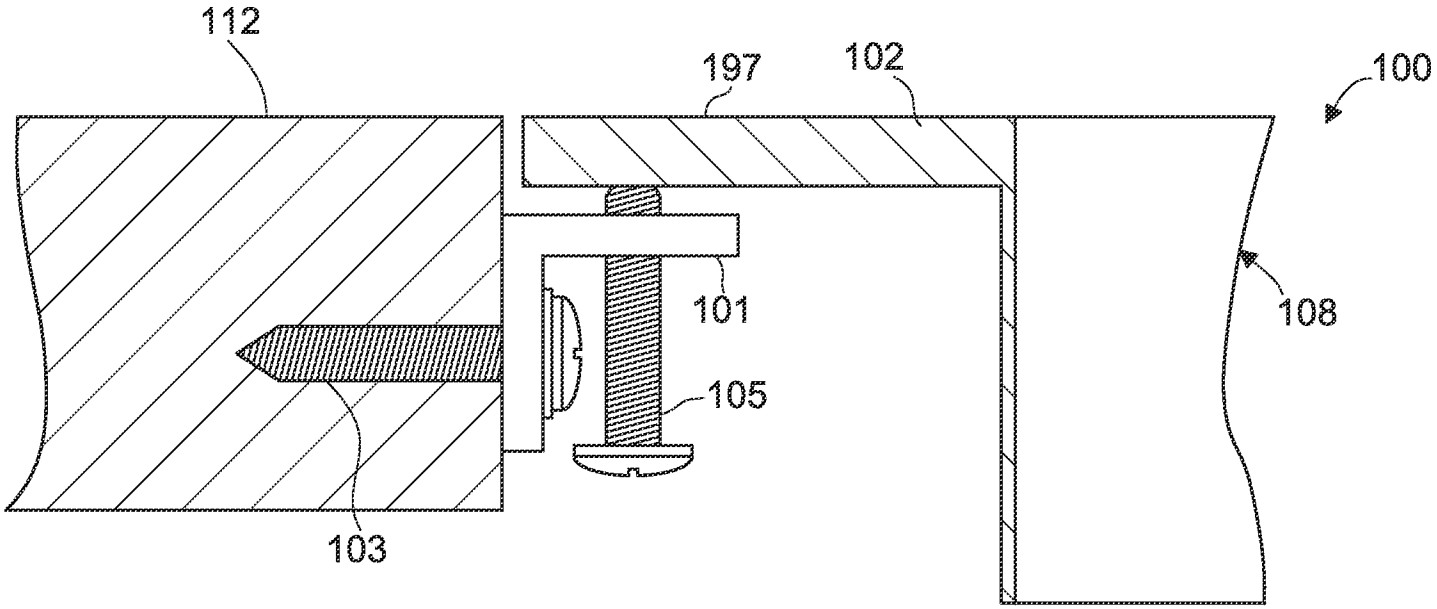
FIG. 19 is a partial cross-sectional side elevation view of a sink assembly including a basin having an outwardly extending peripheral mounting flange, clips configured to be secured to a countertop, and adjustment screws adjustably coupled with the clips, where the adjustment screws are vertically adjustable to support the peripheral mounting flange so that the upper surface of the peripheral mounting flange is flush with the countertop.

FIG. 19 is a partial cross-sectional side elevation view of a sink assembly 100 including a basin 108 having an outwardly extending peripheral mounting flange 102. The peripheral mounting flange 102 has an upper surface 197. Clips 101 are configured to be secured to a countertop 112 (e.g., via one or more screws 103). Adjustment screws 105 are adjustably coupled with the clips 101. The adjustment screws 105 are vertically adjustable to support the peripheral mounting flange 102 so that the upper surface 197 of the peripheral mounting flange 102 is flush with the countertop 112. In some embodiments, a silicone or other sealing compound is used for sealing the sink assembly 100.

As such, those skilled in the art will appreciate that the conception, upon which this disclosure is based, may readily be utilized as a basis for the designing of other structures, methods and systems for carrying out the several purposes of the present disclosure. It is important, therefore, that the claims be regarded as including such equivalent construction insofar as they do not depart from the spirit and scope of the conception regarded as the present disclosure.

What is claimed is:

1. A sink assembly comprising:

a basin comprising a plurality of downwardly depending basin walls, the basin formed of a metallic material; and an outwardly extending peripheral mounting flange extending in its entirety along a single plane and welded to the basin along the periphery of the plurality of downwardly depending basin walls, the peripheral mounting flange formed of a metallic material, the peripheral mounting flange comprising a flat upper surface and a flat lower surface, the peripheral mounting flange and the plurality of downwardly depending basin walls metallurgically integral at their respective points of contact, and the peripheral mounting flange capable of supporting the entire weight of the basin without flexing when the sink is installed in a flush mounted configuration, the peripheral mounting flange having a thickness between two-tenths (0.2) of an inch to six-tenths (0.6) of an inch.

2. The sink as recited in claim 1, wherein the peripheral mounting flange comprises stainless steel having a thickness between two-tenths (0.2) of an inch to six-tenths (0.6) of an inch.

3. The sink as recited in claim 1, wherein the peripheral mounting flange extends outwardly between one-half (0.5) of an inch to six (6) inches from the plurality of downwardly depending basin walls around the periphery of the plurality of downwardly depending basin walls.

4. The sink as recited in claim 1, further comprising a noise reducing device affixed to at least one of the plurality of downwardly depending basin walls.

5. The sink as recited in claim 1, wherein a quotient of the thickness of at least one of the plurality of downwardly depending basin walls divided by the thickness of the peripheral mounting flange comprises between eight one-hundredths (0.08) to fifty-four one-hundredths (0.54).

6. The sink as recited in claim 1, further comprising a second basin comprising a second plurality of downwardly depending basin walls, the second basin formed of a metallic material, the peripheral mounting flange fixedly attached to the second basin along the periphery of the second plurality of downwardly depending basin walls, the peripheral mounting flange and the second plurality of downwardly depending basin walls metallurgically integral at their respective points of contact, and the peripheral mounting flange capable of supporting the entire weight of the basin and the second basin when the sink is installed in a flush mounted configuration.

7. The sink as recited in claim 1, wherein the peripheral mounting flange comprises a square exterior edge.

8. A sink comprising:

a basin comprising a plurality of downwardly depending basin walls, the basin formed of a metallic material; and an outwardly extending peripheral mounting flange fixedly extending in its entirety along a single plane and attached to the basin along the periphery of the plurality of downwardly depending basin walls, the peripheral mounting flange formed of a metallic material, the peripheral mounting flange comprising a flat upper surface and a flat lower surface, the peripheral mounting flange and the plurality of downwardly depending basin walls metallurgically integral at their respective points of contact, and the peripheral mounting flange capable of supporting the entire weight of the basin without flexing when the sink is installed in a flush mounted configuration;

a plurality of clips, each one of the plurality of clips configured to be secured to a countertop; and a plurality of adjustment screws adjustably coupled with the plurality of clips, each one of the plurality of adjustment screws vertically adjustable to support the peripheral mounting flange so that the upper surface of the peripheral mounting flange is flush with the countertop.

9. The sink as recited in claim 8, wherein the peripheral mounting flange is welded to the plurality of downwardly depending basin walls.

10. The sink as recited in claim 8, wherein the peripheral mourning flange comprises stainless steel having a thickness between two-tenths (0.2) of an inch to six-tenths (0.6) of an inch.

11. The sink as recited in claim 8, wherein the peripheral mounting flange extends outwardly between one-half (0.5) of an inch to six (6) inches from the plurality of downwardly depending basin walls around the periphery of the plurality of downwardly depending basin walls.

12. The sink as recited in claim 8, further comprising a noise reducing device affixed to at least one of the plurality of downwardly depending basin walls.

13. The sink as recited in claim 8, wherein a quotient of the thickness of at least one of the plurality of downwardly depending basin walls divided by the thickness of the peripheral mounting flange comprises between eight one-hundredths (0.08) to fifty-four one-hundredths (0.54).

14. The sink as recited in claim 8, further comprising a second basin comprising a second plurality of downwardly depending basin walls, the second basin formed of a metallic material, the peripheral mounting flange fixedly attached to the second basin along the periphery of the second plurality of downwardly depending basin walls, the peripheral mounting flange and the second plurality of downwardly depending basin walls metallurgically integral at their respective points of contact, and the peripheral mounting flange capable of supporting the entire weight of the basin and the second basin when the sink is installed in a flush mounted configuration.

15. A system comprising:

a first basin comprising a first plurality of downwardly depending basin walls, the first basin formed of a metallic material;

a second basin comprising a second plurality of downwardly depending basin walls, the second basin formed of a metallic material; and an outwardly extending peripheral mounting flange extending in its entirety along a single plane and fixedly attached to the first basin along the periphery of the first plurality of downwardly depending basin walls and the second basin along the periphery of the second plurality of downwardly depending basin walls, the peripheral mounting flange formed of a metallic material, the peripheral mounting flange comprising a flat upper surface and a flat lower surface, the peripheral mounting flange, the first plurality of downwardly depending basin walls, and the second plurality of downwardly depending basin walls metallurgically integral at their respective points of contact, and the peripheral mounting flange capable of supporting the entire weights of the first basin and the second basin without flexing when the sink is installed in a flush mounted configuration; and a countertop defining a cut-out configured to receive the outwardly extending peripheral mounting flange so that a vertical exterior edge of the outwardly extending peripheral mounting flange is immediately adjacent to the cut-out, the countertop including a mounting feature to support the outwardly extending peripheral mounting flange so that the flat upper surface of the peripheral mounting flange and a surface of the countertop forma flush horizontal transition.

16. The system as recited in claim 15, wherein the cut-out defined by the countertop comprises an arcuate corner.

17. The system as recited in claim 15, wherein the peripheral mounting flange comprises stainless steel having a thickness between two-tenths (0.2) of an inch to six-tenths (0.6) of an inch.

18. The system as recited in claim 15, wherein the peripheral mounting flange extends outwardly between one-half (0.5) of an inch to six (6) inches from the first plurality of downwardly depending basin walls and the second plurality of downwardly depending basin walls around the periphery of the first plurality of downwardly depending basin walls and the second plurality of downwardly depending basin walls.

19. The system as recited in claim 15, further comprising a noise reducing device affixed to at least one of the first plurality of downwardly depending basin walls and the second plurality of downwardly depending basin walls.

20. The system as recited in claim 15, wherein a quotient of the thickness of at least one of the first plurality of downwardly depending basin walls and the second plurality of downwardly depending basin walls divided by the thickness of the peripheral mounting flange comprises between eight one-hundredths (0.08) to fifty-four one-hundredths (0.54).

* * * * *